US008886095B2

(12) United States Patent
Komatsu et al.

(10) Patent No.: US 8,886,095 B2
(45) Date of Patent: Nov. 11, 2014

(54) POWDER CONTAINER, POWDER SUPPLY DEVICE AND IMAGE-FORMING APPARATUS

(75) Inventors: Makoto Komatsu, Yokohama (JP); Tsukuru Kai, Fujisawa (JP); Hiroshi Hosokawa, Yokohama (JP); Junichi Matsumoto, Yokohama (JP); Tadashi Hayakawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 13/367,534

(22) Filed: Feb. 7, 2012

(65) Prior Publication Data

US 2012/0213555 A1 Aug. 23, 2012

(30) Foreign Application Priority Data

Feb. 17, 2011 (JP) ..... 2011-032406
Nov. 22, 2011 (JP) ..... 2011-255239

(51) Int. Cl.
*G03G 15/08* (2006.01)

(52) U.S. Cl.
CPC ..... *G03G 15/087* (2013.01)
USPC ..... 399/262; 399/263; 399/258; 399/254; 399/13

(58) Field of Classification Search
USPC ..... 399/262, 263, 258, 254, 13
See application file for complete search history.

(56) References Cited

U.S. PATENT DOCUMENTS

| | | | |
|---|---|---|---|
| 5,495,323 | A | 2/1996 | Meetze, Jr. |
| 6,169,864 | B1 | 1/2001 | Baxendell et al. |
| 6,278,853 | B1 | 8/2001 | Ban et al. |
| 6,567,637 | B2 | 5/2003 | Yanagisawa et al. |
| 6,665,508 | B2 | 12/2003 | Sudo et al. |
| 7,321,744 | B2 | 1/2008 | Hosokawa et al. |
| 7,480,476 | B2 | 1/2009 | Hosokawa et al. |
| 7,519,317 | B2 | 4/2009 | Hosokawa et al. |
| 7,697,870 | B2 | 4/2010 | Hosokawa et al. |
| 7,702,262 | B2 | 4/2010 | Taguchi et al. |
| 7,706,699 | B2 | 4/2010 | Taguchi et al. |
| 7,720,417 | B2 | 5/2010 | Taguchi et al. |
| 7,822,371 | B2 | 10/2010 | Taguchi et al. |

(Continued)

FOREIGN PATENT DOCUMENTS

| | | | |
|---|---|---|---|
| CN | 1932678 | A | 3/2007 |
| CN | 101103315 | A | 1/2008 |

(Continued)

OTHER PUBLICATIONS

U.S. Appl. No. 13/318,503, filed Nov. 2, 2011, Makoto Komatsu, et al.

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A powder container which is mounted on an image-forming apparatus body, and houses a powder includes a container body configured to carry the powder housed inside thereof from a first end side to a second end side by rotating, and discharge the powder outside from the second end side, a gear formed in an outer circumference of the container body, and a cover which is mounted on the gear to cover at least a tooth section of the gear.

25 Claims, 36 Drawing Sheets

(56) References Cited

U.S. PATENT DOCUMENTS

| | | | | |
|---|---|---|---|---|
| 7,826,777 | B2 | 11/2010 | Taguchi et al. | |
| 7,835,673 | B2 | 11/2010 | Hosokawa et al. | |
| 7,835,675 | B2 | 11/2010 | Taguchi et al. | |
| 7,853,183 | B2 | 12/2010 | Taguchi et al. | |
| 7,853,184 | B2 | 12/2010 | Taguchi et al. | |
| 7,991,334 | B2 | 8/2011 | Taguchi et al. | |
| 8,005,406 | B2 | 8/2011 | Hosokawa et al. | |
| 2007/0147900 | A1* | 6/2007 | Taguchi et al. | 399/258 |
| 2010/0119264 | A1 | 5/2010 | Yamaguchi et al. | |
| 2010/0189470 | A1 | 7/2010 | Yoshizawa et al. | |
| 2011/0008075 | A1 | 1/2011 | Taguchi et al. | |
| 2011/0249991 | A1 | 10/2011 | Hosokawa et al. | |
| 2011/0286771 | A1 | 11/2011 | Taguchi et al. | |

FOREIGN PATENT DOCUMENTS

| | | | |
|---|---|---|---|
| CN | 201607616 | U | 10/2010 |
| JP | 7-199632 | | 8/1995 |
| JP | 8-220857 | | 8/1996 |
| JP | 9-211977 | | 8/1997 |
| JP | 2000-147878 | A | 5/2000 |
| JP | 2001-271912 | | 10/2001 |
| JP | 2004-280064 | | 10/2004 |
| JP | 2005-99434 | | 4/2005 |
| JP | 2006-72166 | | 3/2006 |
| JP | 2007-178969 | | 7/2007 |
| TW | 200720865 | A | 6/2007 |

OTHER PUBLICATIONS

Combined Chinese Office Action and Search Report issued Sep. 3, 2013, in Chinese Patent Application No. 201210063910.5 with English translation.

Office Action issued May 15, 2014 in Chinese Patent Application No. 2012-10063910.5 (with English Translation).

Taiwanese Office Action for Taiwanese Patent Application No. 101103363 dated Feb. 26, 2014.

* cited by examiner

POWDER CONTAINER, POWDER SUPPLY DEVICE AND IMAGE-FORMING APPARATUS

PRIORITY CLAIM

The present application is based on and claims priorities from Japanese Patent Applications No. 2011-032406, filed on Feb. 17, 2011, and No. 2011-255239, filed on Nov. 22, 2011, the disclosures of which are hereby incorporated by reference in their entirety.

BACKGROUND

1. Technical Field

The present invention relates to a powder container for containing a developer which is a powder to be used in an imaging forming apparatus such as a printer, a facsimile machine, a copy machine or a complex machine equipped with multiple functions, and a powder supply device and an image-forming apparatus including the powder container.

2. Description of the Related Art

When supplying a toner in a powder form to a development device in an image-forming apparatus, a toner contained in a toner cartridge as a powder container (toner container) is supplied by a powder supply device. A sack-like toner cartridge or a bottle-like toner cartridge is generally used. A bottle-like toner cartridge integrated with a gear for rotating a bottle is often used because the toner inside the bottle-like toner cartridge is fed on the toner outlet side by rotating the bottle. By integrally manufacturing the bottle, the manufacturing costs can be controlled, and the manufacturing process can be simplified.

In this configuration, since the gear is located in the outermost area of the toner cartridge, it is required to protect the gear from impact or the like at the time of storage and transportation. Therefore, in order to protect the gear from impact, the entire toner cartridge is packed or a toner discharge mechanism is provided in the toner outlet to cover most parts of the gear by this mechanism. Japanese Patent Application Publication No. H07-199632 describes a configuration in which a cover corresponding to a stopper is provided in the toner outlet for the purpose of preventing the toner from spilling out.

However, since the configuration which protects the gear of the toner cartridge requires a supplemental member such as an additional component or a packing component, the increase in the number of components or the increase in the costs is unavoidable. Specifically, when mounting the toner discharge mechanism on the toner cartridge, it is constitutionally impossible to cover the entire gear, and at least a part of the gear is not covered. For this reason, it is difficult to completely protect the gear. If a user unintentionally sets such a damaged toner cartridge, abnormal noise is generated or a driving system for driving a gear is damaged, which becomes a destabilizing factor of the cartridge rotation, and the stable toner supply is disturbed. If the toner is not stably supplied to a development device, the destabilized toner supply becomes a development error factor, disturbing high quality image formation.

Assuming that a cover which covers a gear is provided, if a fastener which fastens the cover is provided, the length of the toner cartridge is increased by the fastener, and it becomes necessary for the extended portion to have a toner feeding function.

Japanese Patent Application Publication No. H07-199632 describes a cover, but this is for preventing the spilling out of the toner from the toner outlet, and this cover can not protect the gear.

SUMMARY

It is, therefore, an object of the present invention to provide a powder container which can prevent damage of a gear provided in a container with a simple configuration without increasing the entire length of the container, a powder supply device and an image-forming apparatus which can form a high quality image by stably supplying a toner while reducing a rotation error of the powder container, generation of an abnormal noise and damage of a driving system by preventing the damage of the gear.

In order to achieve the above object, one embodiment of the present invention provides a powder container which is mounted on an image-forming apparatus body, and houses a powder, including: a container body configured to carry the powder housed inside thereof from a first end side to a second end side by rotating, and discharge the powder outside from the second end side; a gear formed in an outer circumference of the container body; and a cover which is mounted on the gear to cover at least a tooth section of the gear.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENTS

Embodiments of the present invention will be described hereinafter with reference to the drawings. In the embodiments and modifications, constitutional elements such as members or components, which have the same function or shape, are assigned the same symbol as long as they can be distinguished, and any overlapping description thereof will be omitted.

Figure 2:
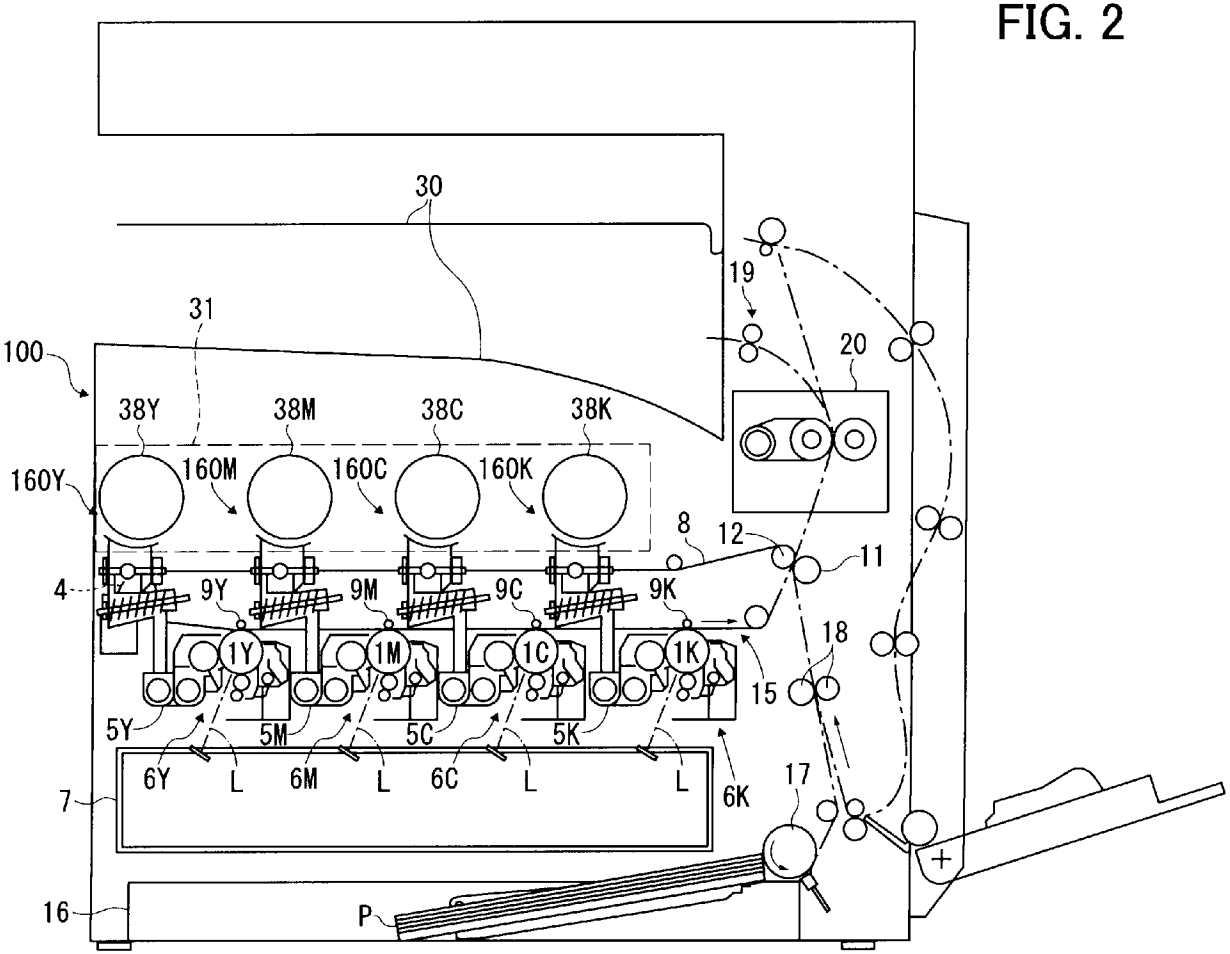
FIG. 2 is a configuration diagram of an image-forming apparatus according to the present invention.

First, an overall configuration and operation of an image-forming apparatus according to the present invention will be described. As shown in FIG. 2, four toner containers 38Y, 38M, 38C, 38K, which are powder containers for respective colors (yellow, magenta, cyan, black), are detachably (replaceably) installed in a toner container housing section 31 which is located on the upper side of a body 101 of an image-forming apparatus 100 and serves as a powder container housing section. An intermediate transfer unit 15 is arranged below the toner container housing section 31. Below an intermediate transfer belt 8 included in the intermediate transfer unit 15, imaging sections 6Y, 6M, 6C, 6K for the respective colors (yellow, magenta, cyan, black) are placed opposed to the intermediate transfer belt 8 and arranged in a belt travel direction. Here, in the embodiments, members for the respective colors (yellow, magenta, cyan, black) are distinguished by assigning symbols of (Y, M, C, B).

The toner containers 38Y, 38M, 38C, 38K contain powdery toners of respective colors. When the toner containers 38Y, 38M, 38C, 38K are attached to the toner container housing section 31, toner supply devices 160Y, 160M, 160C, 160K, which are powder supply devices facing the inside of the toner container housing section 31, supply (refill) the toners of the colors to developing devices in the imaging sections 6Y, 6M, 6C, 6K, respectively.

In this embodiment, as the imaging sections, the toner containers, and the toner supply device have approximately an identical configuration except toner colors, and one configuration representative of each of them will be described hereinafter.

Figure 3:
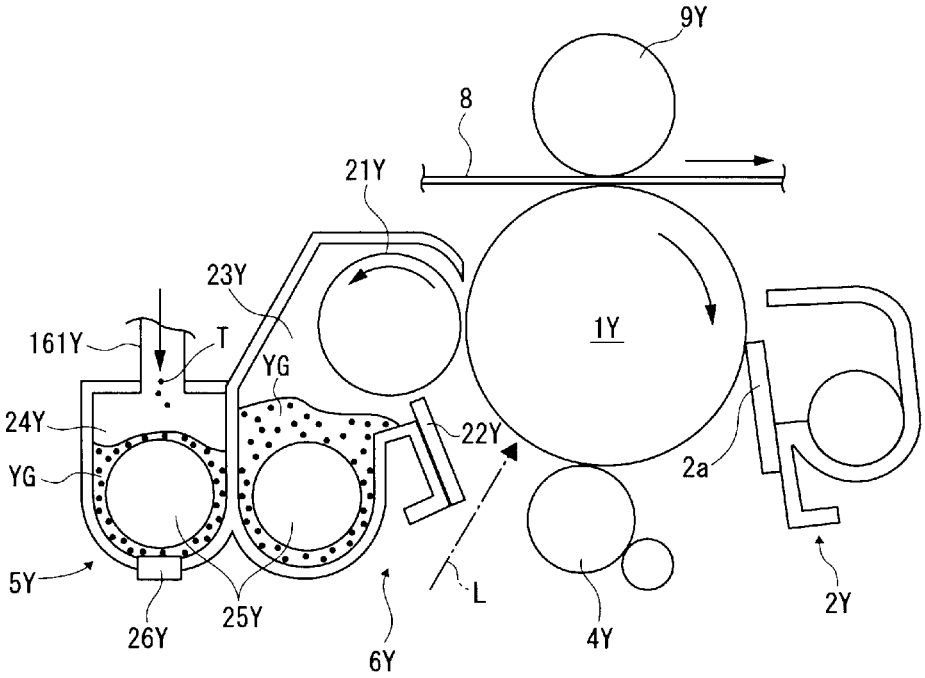
FIG. 3 is an enlarged view showing one embodiment of an image-forming section that the image-forming apparatus as shown in FIG. 2 includes.

As shown in FIG. 3, the imaging section 6Y for yellow is configured as a process cartridge including a photoconductive drum 1Y serving as an image carrier, as well as an electrical-charged section 4Y, a developing device 5Y (developing section), a cleaning section 2Y, a not-shown diselectrification section and the like, which are arranged around the photoconductor drum 1Y, and made detachably attachable to the body 101 of the image-forming apparatus. Then, an imaging process (electrical-charging step, exposure step, development step, transfer step, and cleaning step) is performed to form a yellow image on the photoconductor drum 1Y.

In addition, the other three imaging sections 6M, 6C, 6K also have an almost same configuration as the imaging section 6Y corresponding to yellow, except that a toner color to be used is different, and form images corresponding to respective toner colors.

In FIG. 3, the photoconductor drum 1Y is rotationally driven by a not-shown drive motor in a clockwise direction shown by an arrow in FIG. 3, and a surface of the photoconductor drum 1Y is uniformly charged at a position of the electrical-charged section 4Y (Electrical-charging step).

Then, on the surface of the photoconductor drum 1Y, a laser beam L emitted from an exposure device 7 (see FIG. 2) reaches an irradiation position where as a result of exposure scanning, an electrostatic latent image corresponding to yellow is formed (Exposure step). The surface of the photoconductor drum 1Y reaches an opposed position (developing area) to the developing device 5Y, an electrostatic latent image at this position is developed, and a yellow toner image is formed (Development step).

The surface of the photoconductor drum 1Y after the development reaches a position opposed to the intermediate transfer belt 8 and a primary transfer bias roller 9Y where the toner image on the photoconductive drum 1Y is transferred to the intermediate transfer belt 8 (Primary transfer step). Then, there remains untransferred toner, albeit only slightly, on the photoconductor drum 1Y.

The surface of the photoconductor drum 1Y after the primary transfer reaches a position opposed to a cleaning device 2, where the untransferred toner remaining on the photoconductor drum 1Y is mechanically collected by a cleaning blade 2*a* (Cleaning step). The surface of the photoconductor drum 1Y reaches a position opposed to the not shown diselectrification section, where any remaining potential on the photoconductor drum 1Y is removed. Then, a series of the imaging process performed on the photoconductor drum 1Y ends.

In addition, the imaging process described above is similarly performed to the yellow imaging section 6Y in the other imaging sections 6M, 6C, 6K as well. More specifically, from the exposure device 7 arranged below the imaging section, a laser beam L based on image information is emitted onto the photoconductor drums of the respective imaging sections 6M, 6C, 6K. Particularly, while emitting a laser beam from a light source and scanning the laser beam L with a polygon mirror which is rotationally driven, the exposure device 7 irradiates it onto each photoconductive drum 1M, 1C, 1K via a plurality of optical elements. Then, a toner image of each color formed on each photoconductive drum 1M, 1C, 1K after the development step is superposed on the intermediate transfer belt 8 and transferred. Thus, a color image is formed on the intermediate transfer belt 8.

The intermediate transfer unit 15 comprises the intermediate transfer belt 8, four primary transfer bias rollers 9Y, 9M, 9C, 9K, a secondary transfer backup roller 12, a plurality of tension rollers, and an intermediate transfer cleaning section and the like. The intermediate transfer belt 8 is not only stretched/supported by a plurality of roller members, but also endlessly moved in the arrow direction in FIG. 2 by the rotational driving of the secondary transfer backup roller 12.

The four primary transfer bias rollers 9Y, 9M, 9C, and 9K, respectively sandwich the intermediate transfer belt 8 with the photoconductor drums 1Y, 1M, 1C, 1K, and form primary transfer nips. To the primary transfer bias rollers 9Y, 9M, 9C, 9K, a transfer bias opposite to toner polarity is applied.

The intermediate transfer belt 8 runs in the arrow direction, and sequentially passes through the primary transfer nip of each primary transfer bias roller. Thus, the toner images of respective colors on the photoconductor drums 1Y, 1M, 1C, 1K are superposed on the intermediate transfer belt 8, and primarily transferred.

The intermediate transfer belt 8 on which the toner images of the respective colors are superposed and transferred reaches a position opposed to the secondary transfer roller 11. At this position, a secondary transfer backup roller 12 sandwiches the intermediate transfer belt 8 with the secondary transfer roller 11, and forms secondary transfer nips. The four-color toner images formed on the intermediate transfer belt 8 are transferred on a recording medium P such as transfer paper, etc. and carried to the positions of the secondary transfer nips. Then, there remains untransferred toner which was not transferred to the recording medium P in the intermediate transfer belt 8. The intermediate transfer belt 8 reaches a position of a not shown intermediate transfer cleaning section, where the untransferred toner on the intermediate transfer belt 8 is collected. Thus, a series of the transfer process performed on the intermediate transfer belt 8 ends.

The recording medium P transferred to positions of the secondary transfer nips is that transferred from a paper feed section 16, which is arranged in the lower part of the body 101 of the image-forming apparatus, via a paper feed roller 17 or a pair of registration rollers 18 and the like. Particularly, multiple sheets of recording medium P such as transfer paper and the like are stacked and stored in the paper feed section 16. Then, when the paper feed roller 17 is rotationally driven in an anticlockwise direction in FIG. 2, a top recording medium P is fed to an inter-roller space of the resist rollers 18.

The recording medium P transferred to a pair of registration rollers 18 once stops at a position of a roller nip of a pair of registration rollers 18 which stopped the rotational drive. Then, a pair of registration rollers 18 is rotationally driven in line with timing of the color image on the intermediate transfer belt 8, and the recording medium P is transported to the secondary transfer nips. Thus, a desired color image is transferred onto the recording medium P. The recording medium P the color image of which was transferred at the position of the secondary transfer nips is transported to a position of a fixing section 20. Then, at this position, due to heat and pressure of a fixing belt and a pressurization roller, the color image transferred onto the surface is fixed on the recording medium P.

The recording medium P after the fixing is discharged to the outside of the device by way of the inter-roller space of a pair of paper ejection rollers 19. The recording medium P ejected to the outside of the device by the pair of paper ejection rollers 19 is sequentially stacked as output images on a stack section 30. Then, a series of image-forming processes on the image-forming apparatus is completed.

Next, with reference to FIG. 3, a configuration and operation of a developing device in an imaging section will be further described in detail. A development device 5Y comprises a developing roller 21Y opposed to a photoconductive drum 1Y, a doctor blade 22Y opposed to the developing roller 21Y, two transport screws 25Y arranged in developer containers 23Y and 24Y, a density detection sensor 26Y configured to detect the density of a toner in a developer, and the like. The developing roller 21Y comprises a magnet fixedly installed therein and a sleeve turning around the magnet, and the like. The developer containers 23Y and 24Y contain a two-constituent developer YG consisting of a carrier and a toner. The developer container 24Y is in communication with a toner drop path 161Y via an opening formed in an upper part of the developer container.

The developing device 5 thus configured operates in the following manner. The sleeve of the developing roller 21Y turns in the arrow direction in FIG. 3. Then, the developer YG carried on the developing roller 21Y due to a magnetic field formed by the magnet moves on the developing roller 21Y with rotation of the sleeve. The developer YG in the developing device 5Y is adjusted so that a proportion of a toner in the developer (toner density) is within a predetermined range. Specifically, a toner contained in a toner container 38Y is supplied into the developer container 24Y from a toner supply device 160Y through the toner drop path 161Y, according to consumption of the toner in the developing device 5Y.

Then, the toner supplied into the developer container 24Y circulates in the two developer containers 23Y, 24Y, while being mixed and agitated by the two transport screws 25Y together with the developer YG (which is movement in a vertical direction in FIG. 3). The toner in the developer YG adheres to the carrier due to frictional electrification with the carrier, and is carried on the developing roller 21Y with the carrier by a magnetic force formed on the developing roller 21Y.

The developer YG carried on the developing roller 21Y is transported in the arrow direction in FIG. 3, and reaches a position of the doctor blade 22Y. After the developer YG on the developing roller 21Y is adjusted to an adequate amount at this position, the developer YG on the developing roller 21Y is transported to a position (development area) opposed to the photoconductor drum 1Y. Then, a toner adheres to a latent image formed on the photoconductor drum 1Y, due to an electric field formed in the development area. Thereafter, the developer YG remaining on the developing roller 21Y reaches an upper area of the developer container 23Y with rotation of the sleeve, and leaves the developing roller 21Y in this position.

Next, toner supply devices 160Y, 160M, 160C, 160K and toner containers 38Y, 38M, 38C, 38K will be described. Respective toner supply devices and toner containers have an identical configuration, except a color of a toner in a toner container to be set. Thus, they will be described as a toner supply device 160 and a toner container 38 with no toner-color-identifying letter, Y, M, C, K, attached.

Figure 1A:
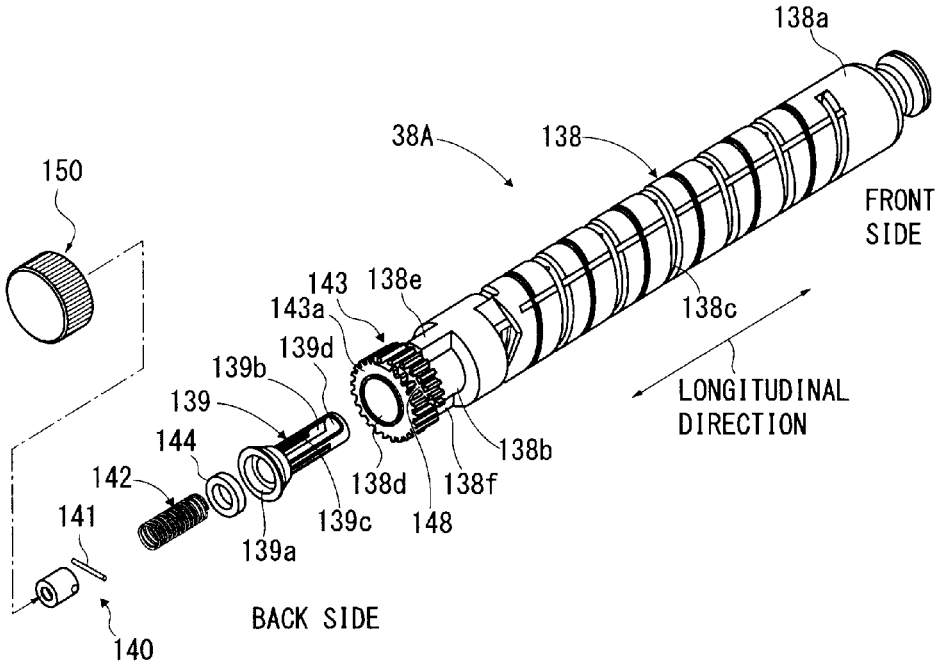
FIG. 1A is an exploded perspective view showing one embodiment of a powder container including a cap according to the present invention.
Figure 1B:
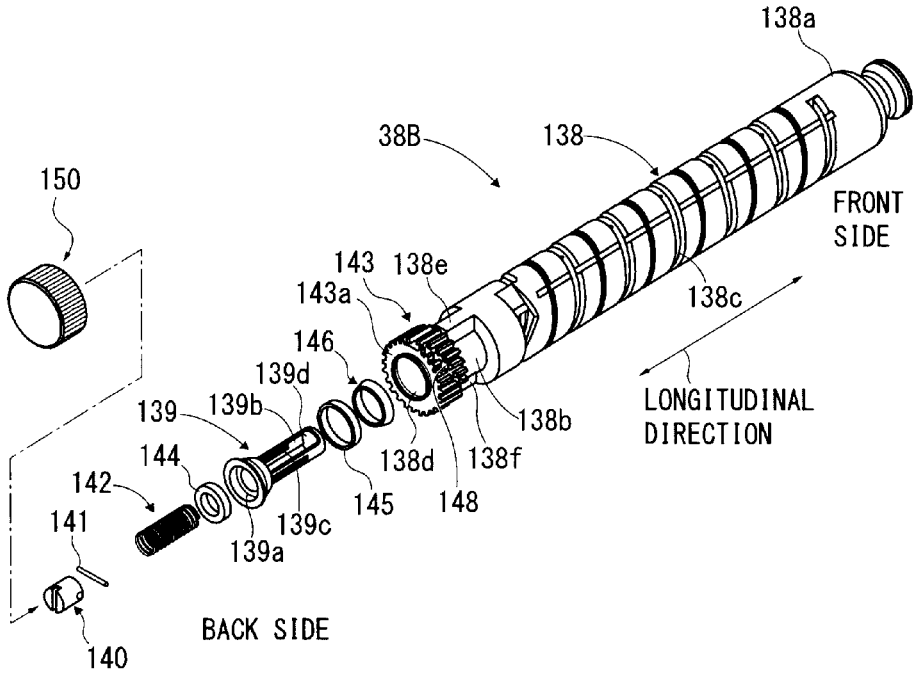
FIG. 1B is an exploded perspective view showing another embodiment of a powder container including a cap according to the present invention.

As shown in FIG. 1A and FIG. 1B, the toner container 38 according to the embodiment of the present invention is roughly divided into two types.

Figure 4:
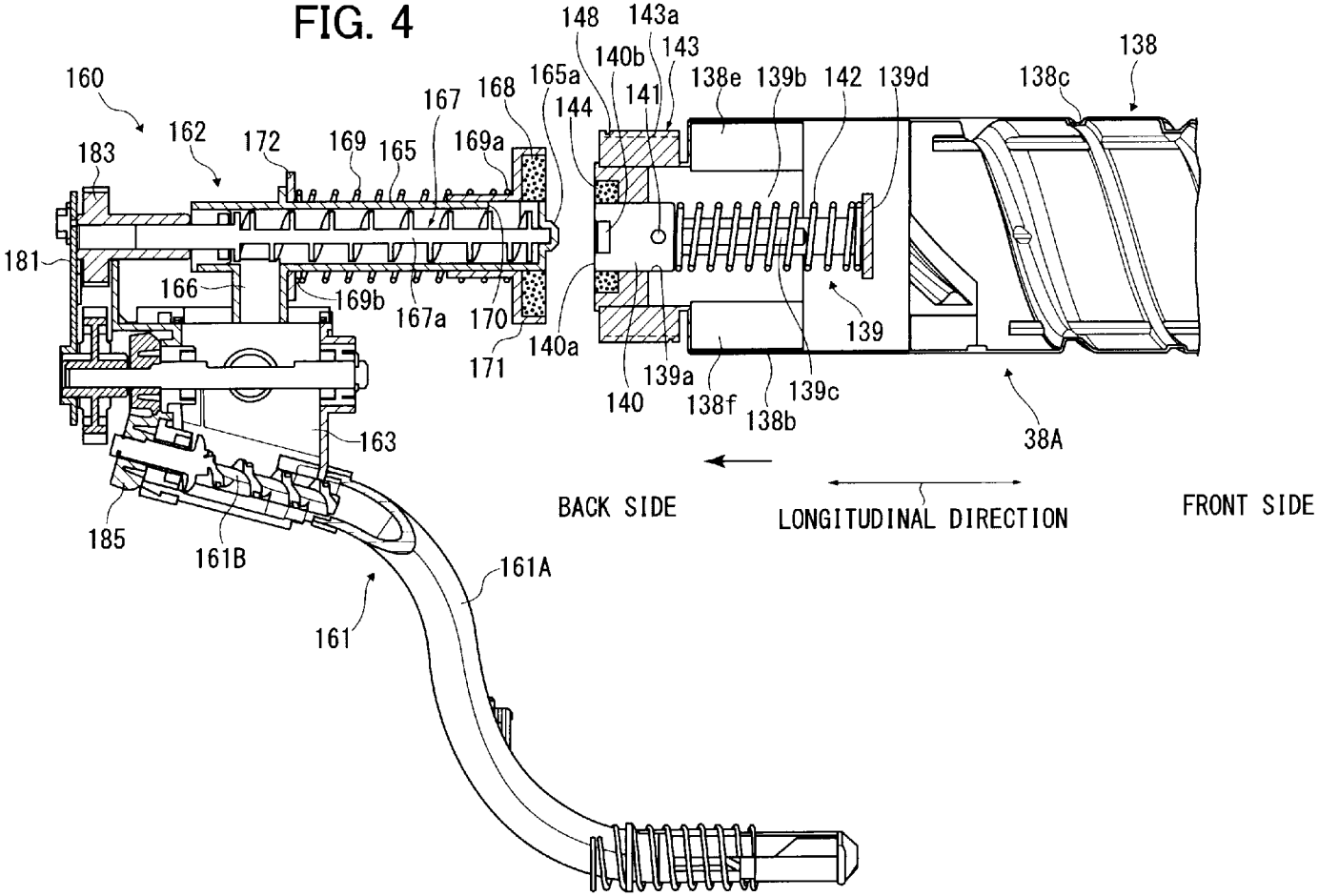
FIG. 4 is a partial sectional view showing a configuration of a powder supply device including the powder container shown in FIG. 1A.

A toner container 38A shown in FIG. 1A and FIG. 4 includes a container body 138 in which a toner is contained therein, a nozzle receiver 139 having a nozzle-receiving hole (insertion section) 139*a* arranged on the second end side 138*b* of the container body 138 and configured to allow a transport nozzle 162 having a powder-receiving inlet 170 to be inserted therein, and a supply port 139*b* arranged in at least a part of the nozzle receiver and configured to supply a powdery toner in the container body 138, to the powder-receiving inlet 170, a shutter 140 which is a shutter supported by the nozzle receiver 139 and configured to open and close the nozzle-receiving hole (insertion section) 139*a* by sliding in response to the insertion of the transport nozzle 162 into the nozzle receiver 139, a gear 143 having in the entire circumference tooth sections 143*a*, and a cap 150 as a cover which is mounted on the gear to cover at least the tooth sections 143*a* of the gear 143 from the entire circumferential direction, and is of a type wherein the nozzle receiver 139 fixed to the container body 138 rotates integrally therewith.

The tubular container body 138 has helical projections 138*c*, which protrude toward the inside of the container, formed from a first end side 138*a* to the second end side 138*b* on its circumferential surface, and is configured to transport a toner contained therein from the first end side 138*a* to the second end side 138*b* as the container body 138 rotates.

On an end face of the second end side 138*b* of the container body 138 are formed an opening 138*d* into which the nozzle receiver 139 is inserted, lift-up sections 138*e*, 138*f* for lifting up any toner transported by the helical projection 138*c* and accumulating in a lower part of the second end side 138*b* or any toner which has accumulated in the lower part of the second end side 138*b* from the beginning, in the container because of rotation of the container body 138, and a driving part, for example, a gear 143 to which a driving force for rotating the container body 138 is transmitted. In the embodiment, the lift-up sections 138*e*, 138*f* are arranged such that they are opposed to each other with their phases offset 180 degrees. Although there are multiple lift-up sections 138*e*, 138*f* in the embodiment, there may be any one of the lift-up sections 138*e*, 138*f*, which may be arranged as four lift-up sections with their phases offset 90 degrees. Alternatively, the lift-up sections may be increased to four or more, and may have a number and a shape which allow them to supply a toner to a supply port 139*b* and the powder-receiving inlet 170, to be described below, from above them.

The nozzle receiver 139 forms approximately a cylindrical shape extending in a longitudinal direction of the container body 138. As shown in FIG. 4, on one end of the nozzle receiver is formed the nozzle-receiving hole (insertion section) 139*a* fitting to the opening 138*d* formed on the container body 138. On an outer circumferential surface of the nozzle receiver 139 is formed a pair of slits 139*c* which extend in the longitudinal direction of the nozzle receiver 139 and are arranged to face each other. The nozzle receiver 139 has at an outer circumferential surface thereof a supply port 139*b* opened to extend in a longitudinal direction of the nozzle receiver 139. The nozzle-receiving hole 139*a* and the supply port 139*b* are formed to be in communication in the nozzle receiver 139. The supply port 139*b* is formed such that at least a part thereof is located in a moving range of the shutter 140. The diameter of the nozzle-receiving hole 139*a* on the opening end side is increased, and a ring-shaped seal member 144 comprising a sponge member for preventing the toner from spilling is attached to the inside of the nozzle-receiving hole 139*a*.

Figure 8:
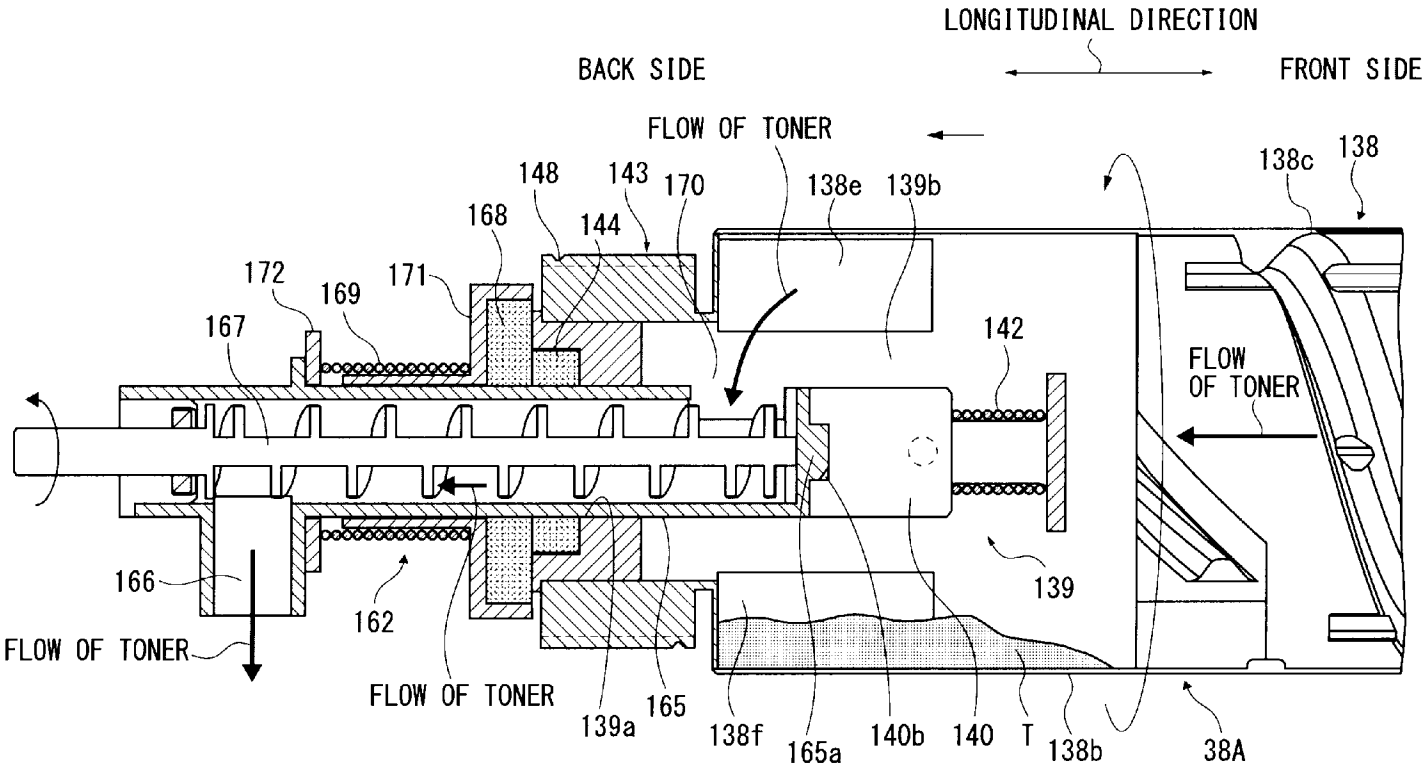
FIG. 8 is an enlarged sectional view showing that a transport nozzle that the powder supply device shown in FIG. 4 includes is attached to the powder container.

The shutter 140 is a tubular shape and inserted into the nozzle receiver 139. The shutter 140 is movably supported in the longitudinal direction of the nozzle receiver 139, as it supports a pin 141, which diametrically penetrates, in each slit 139*c* of the nozzle receiver 139. A coil spring 142 which is an urging member is interposed between the end face 139*d* of the nozzle receiver 139 located opposite to the nozzle-receiving hole 139*a* and the shutter 140. The shutter 140 is urged by the coil spring 142 to a position to close the nozzle-receiving hole 139*a* (closed position), as shown in FIG. 4. The shutter 140 is configured to close a part of the supply port 139*b* as well as the nozzle-receiving hole 139*a* when the closed position is closed. The shutter 140 is such configured that when the transport nozzle 162 is inserted into the nozzle receiver 139, the shutter 140 slides into the container from the closed position as shown in FIG. 4 to open the nozzle-receiving hole 139*a* and the supply port 139*b*, and also moves to an open position as shown in FIG. 8 where the nozzle-receiving hole 139*a* and the supply port 139*b* are in communication. In the embodiment, since the supply port 139*b* opens to an area adjacent to the nozzle-receiving hole 139*a*, the nozzle-receiving hole 139*a* and the supply port 139*b* are closed if the shutter 140 is in the closed position. However, if the supply port 139*b* is formed closer to the end face 139*b*, only the nozzle-receiving hole 139*a* is closed when the shutter 140 is in the closed position.

The toner container 38A configured as such is attached by sliding it from the front side to the back side of the body 101 of the image-forming apparatus so that the second end side 138*b* of the container body 138 is located in the back side of a toner container housing section 31. The configurations of the gear 143 and the cap 150 will be described in the latter paragraphs.

Figure 5:
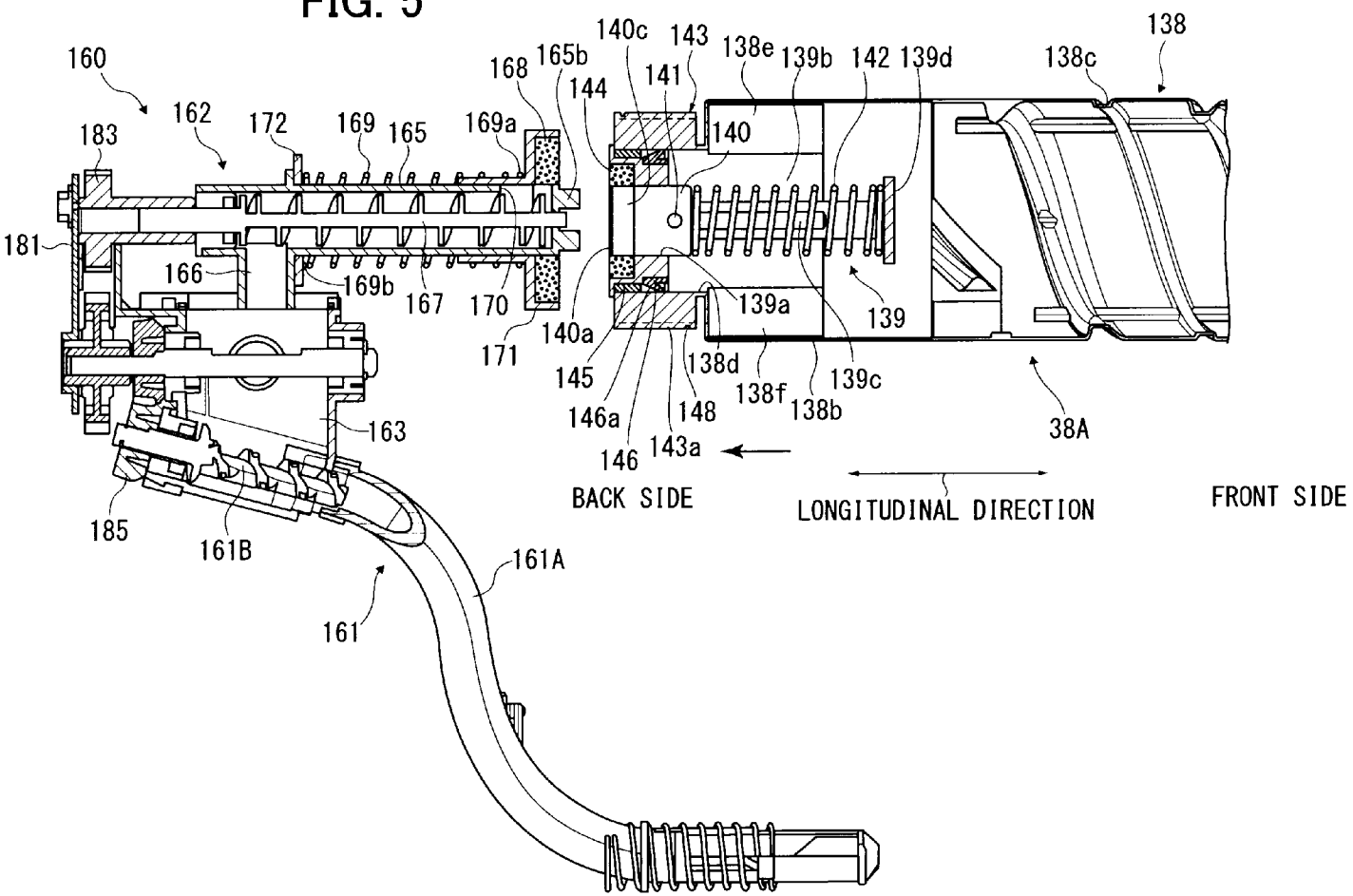
FIG. 5 is a partial sectional view showing a configuration of a powder supply device including the powder container shown in FIG. 1B

The toner container 38B shown in FIG. 1B and FIG. 5 includes a container body 138 in which a toner is contained, a nozzle receiver 139, a shutter 140, and a gear 143, and a cap 150 as a cover which is mounted on the gear to cover the gear from the entire circumferential direction, and is configured such that the nozzle receiver 139 is supported to be rotatable with respect to the container body 138. The container body 138 and the nozzle receiver 139 have the same configurations as in the toner container 38A shown in FIG. 1A. The toner container 38B differs from the toner container 38A in that an end of the shutter 140 has a different configuration and in that two members are added. In FIG. 1B, the toner container 38B further includes a bearing member indicated by reference numeral 145 and a seal member indicated by reference numeral 146 as the two members. The ring-shaped bearing member 145 is interposed between an opening 138*d* of the container body 138 and a nozzle-receiving hole 139*a* of the nozzle receiver 139, and supports the nozzle receiver 139 rotatably with respect to the container body 138. The seal member 146 is attached to the outer circumferential surface of the nozzle receiver 139 extending from the bearing member 145 toward the inside of the container body 138. In the seal member 146, an umbrella-like lip member 146*a* is inclined to and extends from a ring-shaped base continuously in a circumferential direction. The seal member 146 is made of a rubber or resin such that the seal member 146 can elastically deform and contact an inner circumferential surface of the opening 138*d* of the container body 138 when the nozzle receiver 139 is inserted into the container body 138.

The toner container 38B configured as such is attached by sliding it from the front side to the back side of the body 101 of the image-forming apparatus so that the second end side 138*b* of the container body 138 is located in the back side of a toner container housing section 31.

There are two types of supply devices 160: One is used with the toner container 38A shown in FIG. 1A and the other with the toner container 38B shown in FIG. 1B. As they have a same configuration except for a connection section with the shutter 140, their common configuration will be described here, and differences in the configuration will be described individually. FIG. 5 is an overall diagram of the toner supply device 160.

The toner supply device 160 shown in FIG. 4 is used with the toner container 38A shown in FIG. 1A. The toner supply device 160 shown in FIG. 5 is used with the toner container 38B shown in FIG. 1B.

Each of toner supply devices 160 has the toner container 38A, 38B, a transport nozzle 162 inserted in each toner to receive toner supply, and a transport path 161 connected to the transport nozzle 162 and a developing device 5 and transporting a toner supplied to the transport nozzle 162 to the developing device 5. The transport nozzle 162 is arranged in the back side of the toner container housing section 31 (the body 101 of the image-forming apparatus) to be opposed to the shutter 140 which is inserted into the toner container housing section 31. A sub hopper 163 for storing a toner to be transported by the transport nozzle 162 is provided between the transport nozzle 162 and the transport path 161, and the toner is supplied to the transport path 161 via the sub hopper 163.

As shown in FIG. 4, the transport path 161 includes a hose 161A, and a transport screw 161B arranged in the hose 161A and transporting the toner from the sub hopper 163 to the developing device 5 by rotating.

The transport nozzle 162 includes a tubular nozzle section 165 to be inserted into the nozzle receiver 139 of the toner container 38A, 38B, a connection path 166 connecting the nozzle section 165 and the sub hopper 163, a transport screw 167 arranged in the nozzle section 165 and transporting the toner supplied from the toner containers 38A, 38B to the connection path 166, a seal member 168 forming a seal surface by contacting the seal member 144 of the shutter 140, and a coil spring 169 as an urging device.

The nozzle section 165 extends in the longitudinal direction of the toner container, and its outer circumference can be inserted into the nozzle receiver 139 from the nozzle-receiving hole 139*a*. On the outer circumferential surface on the tip side of the nozzle section 165 is formed a powder-receiving inlet 170 which receives a toner from the supply port 139*b* of the toner container 38A, 38B and guides it to the transport screw 167. A length of the nozzle section 165 is set so that the powder-receiving inlet 170 can be opposed to the supply port 139*b* when the nozzle section is inserted into the nozzle receiver 139.

The connection path 166 is formed integrally with a base end of the nozzle section 165 located on the opposite side of the powder-receiving inlet 170, and in communication with the nozzle section 165. The powder-receiving inlet 170 is formed such that it is located on a top face of the nozzle section 165.

A screw section 167*a* is formed from the tip of the nozzle section 165 to the connection path 166, and the transport screw 167 is rotatably supported by the nozzle section 165. The seal member 168, formed of a sponge and shaped like a ring, is attached to a holder 171 supported movably in the longitudinal direction in the outer circumferential surface of the nozzle section 165.

In the coil spring 169, one end 169*a* is latched to the holder 171 held slidably on the outer circumferential surface of the nozzle section 165 and rotatably about the axis center, and the other end 169*b* is latched to a spring receiving member 172 held on the outer circumferential surface of the nozzle section 165. In this state, the coil spring 169 urges the seal member 168 toward a seal member 144 (to a direction in which the holder 171 moves away from the spring receiving member 172).

The powder-receiving inlet 170 is formed to be opposed to the supply port 139*b* of the nozzle receiver 139, when the nozzle section 165 is inserted into the container body 138 from the nozzle-receiving hole 139*a* of the nozzle receiver 139.

Figure 6:
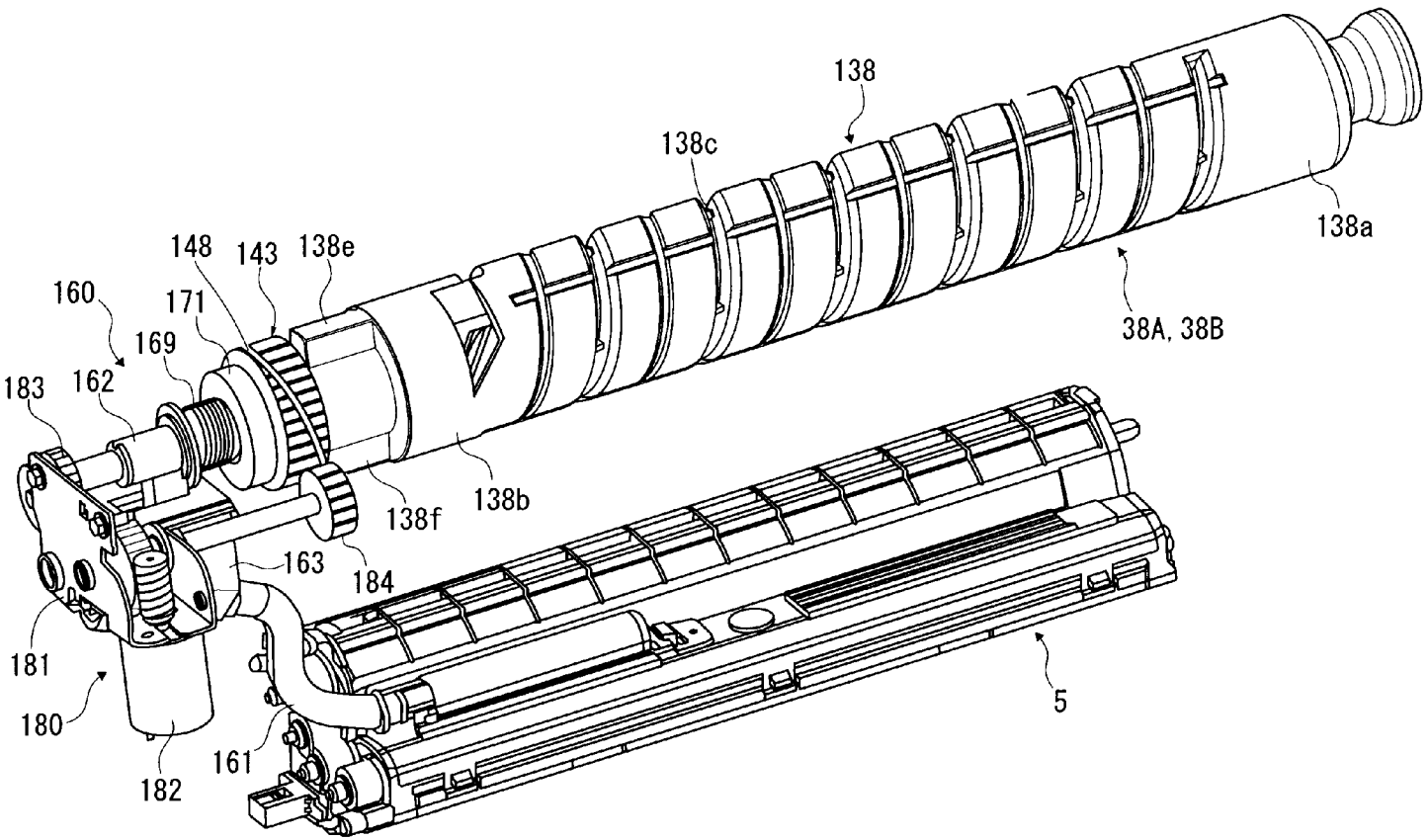
FIG. 6 is a perspective view showing an overall configuration of the powder container according to the present invention and showing that it is connected with a developing device.
Figure 7:
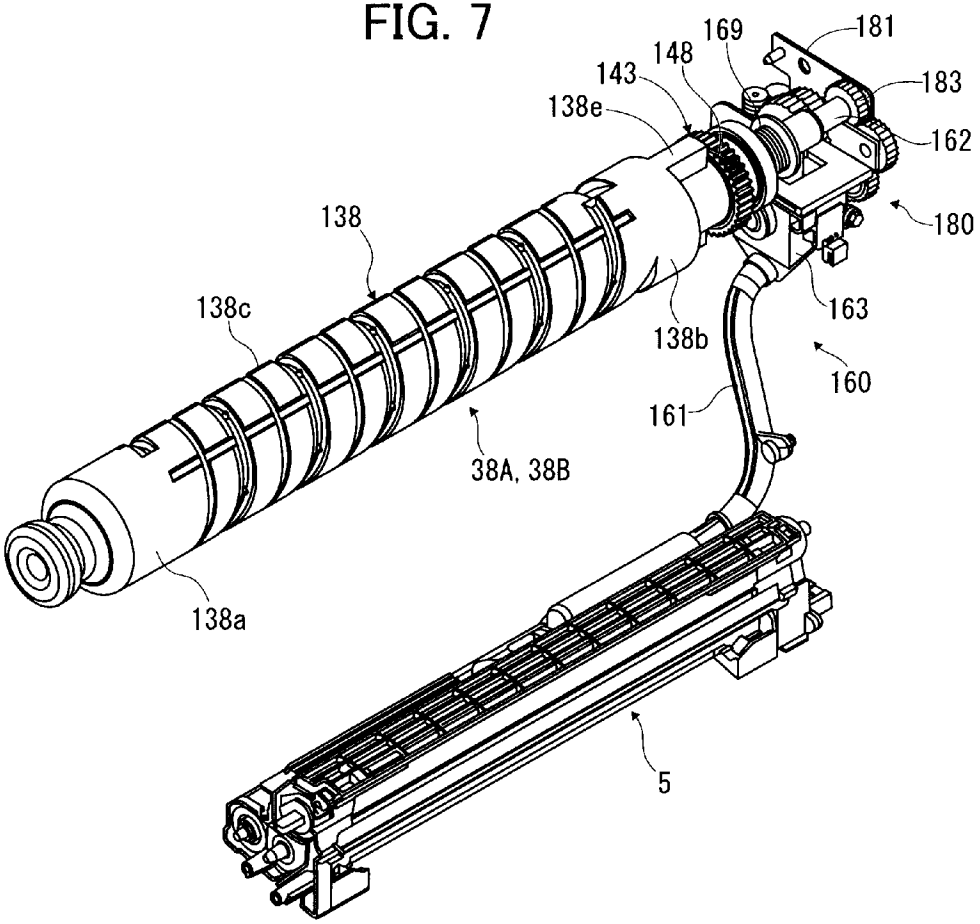
FIG. 7 is a perspective view showing an overall configuration of the powder container according to the present invention and showing that it is connected with a developing device.

A drive device 180 of the toner supply device 160 will be described. As shown in FIG. 6 and FIG. 7, the drive device 180 includes a drive motor 182 which is a drive source fixed to a frame 181, a gear 183 fixed to an end of the transport screw 167, a gear 184 to mesh with the gear 143 of the container body 138 when the toner container 38A, 38B is mounted to the toner container housing section 31 (see FIG. 2), a gear 185 fixed to an end of the transport screw 161B shown in FIG. 4 and FIG. 5, and a gear train meshing with the gears 183 to 185 and transmitting rotation of the drive motor 182 to each gear. The drive motor 182 is controlled by a control device so that the drive device will rotate for a certain period of time, when the control device detects a toner signal with the toner container 38A, 38B mounted to a toner container housing section 31.

Next the difference between the toner supply device 160 shown in FIG. 4 and the toner supply device 160 shown in FIG. 5 will be described. For the toner supply device 160 shown in FIG. 4 which engages with the toner container 38A shown in FIG. 1A, a circular recessed section 140*b* is formed on an end face 140*a* of the shutter 140 of the toner container 38A, a circular protrusion 165*a* insertable into the recessed section 140*b* is formed at a tip of the nozzle section 165, and a contact face of the recessed section 140*b* and the protrusion 165*a* is made a sliding surface. In contrast, for the toner supply device 16 shown in FIG. 5, a recessed section 140*c* is formed on the end face 140*a* of the shutter 140 of the toner container 38B, and a protrusion 165*b* is formed at the tip of the nozzle section 165 so as to enter into the recessed section 140*c* and engage with the recessed section 140*c*, thereby fixing the shutter 140.

In the toner supply device 160 shown in FIG. 4, if the toner container 38A rotates, the shutter 140 held to the nozzle receiver 139 also rotates integrally. However, since the contact face of the recessed section 140*b* and the protrusion 165*a* is made the sliding surface, the rotation is not disturbed. In addition, in the toner container 38A, the nozzle receiver 139 is fixed to and integrated with the container body 138. Once the nozzle receiver 139 is fixed, a positional relationship with the container body 138 is established. Thus, when the nozzle receiver 139 is fixed to the container body 138, it is arranged so that at least the supply port 139*b* is opposed to the lift-up section 138*e* or the lift-up section 138*f* of the container body 138 and located at a position where a toner lifted by the lift-up sections drops.

In contrast, in the toner supply device 160 shown in FIG. 5, if the toner container 38B rotates, the shutter 140 and the container body 138 rotate relatively because rotation of the shutter 140 is disturbed by engagement of the recessed section 140*c* and the protrusion 165*b*, and thus rotation of the nozzle receiver 139 is also disturbed, although the shutter 140 held to the nozzle receiver 139 of the toner container 38B is rotatably supported to the container body 138. In addition, when the toner container 38B shown in FIG. 5 is used, specifying a positional relationship of the supply port 139*b* and the lift-up sections 138*e*, 138*f* of the container body 138 is difficult because in a state before the toner container 38B is mounted to the toner container housing section 31, the nozzle receiver 139 and the container body 138 are supported so that they can relatively rotate. Thus, the recessed section 140*c* and the protrusion 165*b* can be configured as a positioning unit of the supply port 139*b* and the powder-receiving inlet 170 so that positions of the supply port 139*b* and the powder-receiving inlet 170 provided in the nozzle part 165 are aligned when the recessed section 140*c* engages with the protrusion 165*b*.

Figure 9:
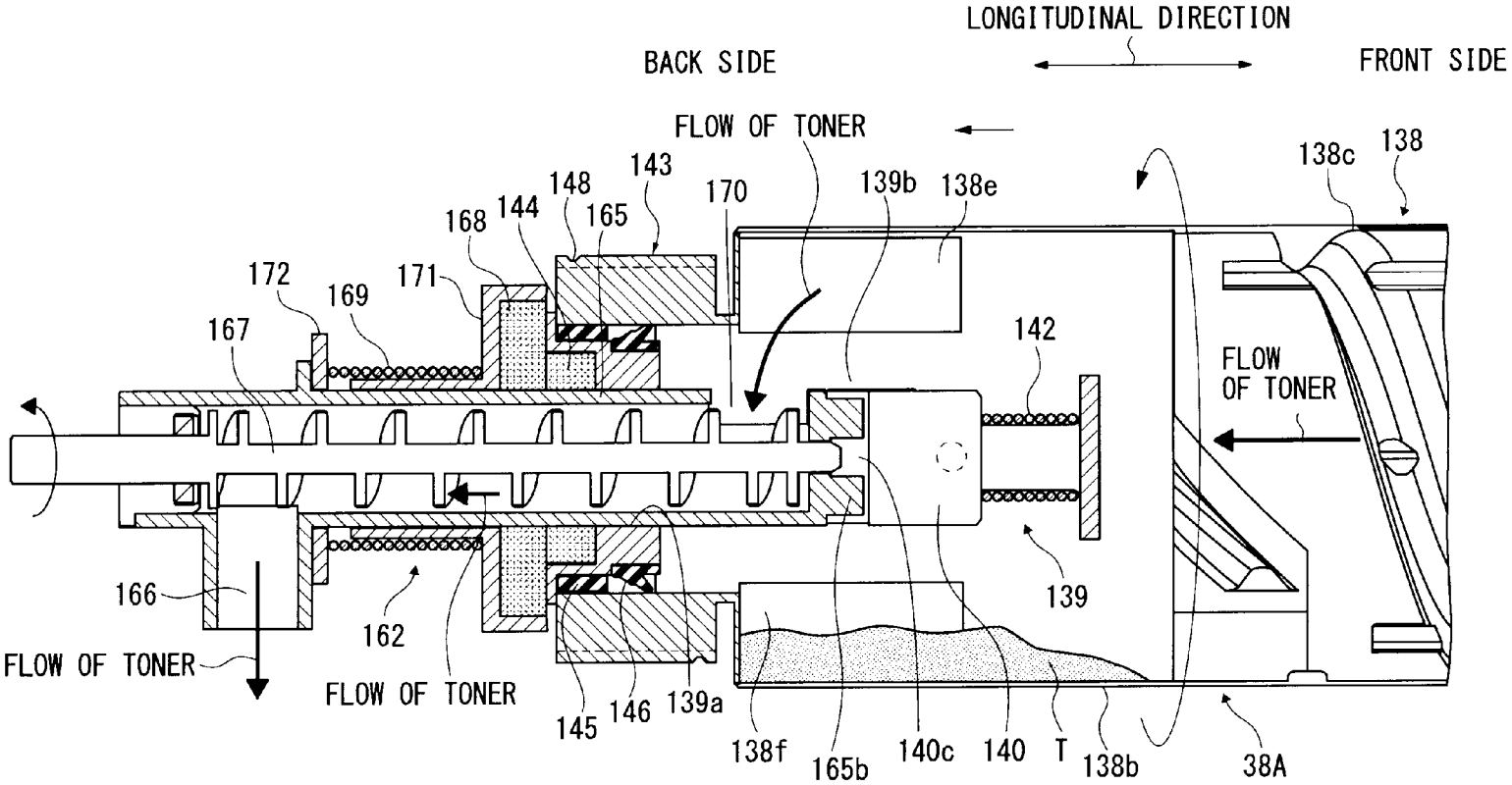
FIG. 9 is an enlarged sectional view showing that the transport nozzle that the powder supply device shown in FIG. 5 includes is attached to the powder container.

In the embodiment shown in FIG. 5 and FIG. 9, the powder-receiving inlet 170 is formed on the top face of the nozzle member 165, and its orientation remains unchanged when the toner container 38A, 38B rotates. This is thus preferable since a toner in the toner container can be reliably supplied to the powder-receiving inlet 170, if the recessed section 140*c* and the protrusion 165*b* are formed so that the supply port 139*b* faces the top face when each toner container is mounted to the toner container housing section 31.

With reference to FIG. 4 to FIG. 12B, operation of the toner supply device 160 thus configured will be described. While the toner container 38A, 38B is transported or stored before being mounted to the toner container housing section 31 shown in FIG. 2, the nozzle-receiving hole 139*a* is closed by the shutter 140 urged by the coil spring 142. That is to say, the toner container is in an almost sealed state as communication between the nozzle-receiving hole 139*a* and the supply port 139*b* is blocked. From this state, as shown in FIG. 4 and FIG. 5, the toner container 38A, 38B is horizontally inserted into the toner container housing section 31 with the opening 138*d* side as a tip side. As the insertion proceeds, the tip of the nozzle section 165 comes into contact with the end face 140*a* of the shutter 140. Then, in the case of the toner supply device 160 shown in FIG. 4, not only is the protrusion 165*a* at the tip of the nozzle section 165 inserted into the recessed section 140*b* of the shutter 140, but also the seal member 144 contacts the seal member 168. If the toner supply device 160 shown in FIG. 5 is used, the protrusion 165*b* of the nozzle section 165 engages with the recessed section 140*c* of the shutter section 140, and as a result of the engagement of both of them, the shutter 140 is fixed and positioned.

Figure 10:
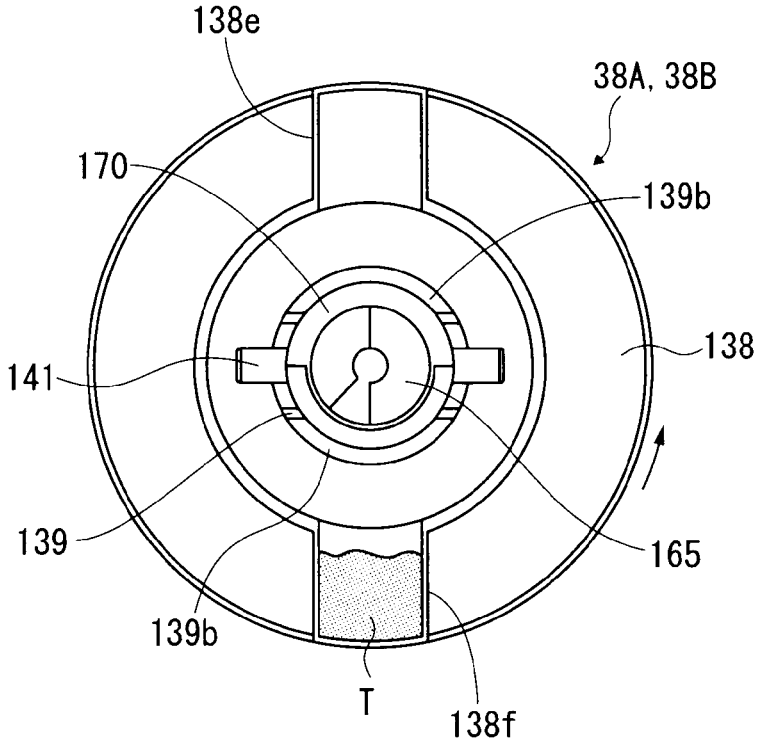
FIG. 10 is a sectional view showing that the powder container is attached to the transport nozzle.

When the toner container 38A, 38B is further moved to the back side, as shown in FIGS. 8 and 9, the shutter 140 is pushed into the container body 138*b* by the nozzle section 165 against an urging force of the coil spring 142. In addition, with the movement of the toner container 38A, 38B, the seal member 168 is also pushed into the back side by the toner container 38A, 38B against an urging force of the coil spring 169. Thus, the seal member 168 and the seal member 144 are in a state in which they are pressed against each other, and sealing of the nozzle-receiving hole 139*a* is thus ensured. The toner container 38A, 38B stops moving when totally housed in the toner container housing section 31 and the first end side 138*b* of the container body 138 is rotatably supported by a support, and occupies a mounted position. The shutter 140 is further slid into the container by the nozzle section 165 until the toner container 38A, 38B occupies the mounted position. By the toner container 38A, 38B occupying the mounted position, the shutter 140 stops sliding and occupies an open position as shown in FIGS. 8 and 9. Then, not only the nozzle-receiving hole 139*a* but also the supply port 139*b* are opened, and as shown in FIG. 10, the powder-receiving inlet 170 is formed in the nozzle receiver 139 and opposed to the supply port 139*b* located above, and thus communicates with the inside of the toner container.

With the toner container 38A, 38B configured as such, as the toner container 38A, 38B has the nozzle receiver 139 arranged on the second end side 138*b* of the container body 138 and configured to allow the nozzle section 165 of the transport nozzle 162 having the powder-receiving inlet 170 to be inserted therein and supply the toner in the container body 138 to the powder-receiving inlet 170, and the shutter 140 supported by the nozzle receiver 139 to be able to open and close the nozzle-receiving hole 139*a* and sliding in response to an insertion of the nozzle section 165 into the nozzle receiver 139 to open and close at least the nozzle-receiving hole 139*a* and the supply port 139*b* leading to the nozzle-receiving hole 139*a* in the embodiment, the nozzle-receiving hole 139*a* and the supply port 139*b* are kept in a closed state until the nozzle section 165 is inserted into the nozzle receiver 139. When the shutter 140 slides in response to the insertion of the nozzle section 165 into the nozzle receiver 139, the nozzle-receiving hole 139*a* is opened and the shutter 140 pushes away any toner accumulated around the supply port 139*b* into the container. Consequently, a space is secured around the supply port 139*b*, which enables reliable supply of toner T to the powder-receiving inlet 170. Thus, the toner contained in the container can be reliably discharged to the outside of the container, while preventing the toner T from spilling and flying.

When the image-forming apparatus is actuated with the toner container 38A, 38B located at the mounted position, and when a toner supply signal is outputted from the not shown control device, the drive motor 182 shown in FIGS. 6, 7 is rotationally driven. When the drive motor 182 is rotationally driven, its drive force is transmitted to the gear 143 via the gear 184, thus rotating the toner container 38A, 38B. The drive force of the drive motor 182 is also transmitted to the transport screw 167 in the nozzle section 165 via the gear 183, and the transport screw 167 rotates in a direction to transport the toner to the connection path 166. In addition, the drive force of the drive motor 182 is also transmitted to the transport screw 161B in the connection path 161 via the gear 185 as shown in FIGS. 4 and 5, and the transport screw 161B rotates in a direction to transport the toner to the developing device 5.

When the toner container 38A, 38B rotates, the toner contained in the container is transported to the second end side 138*b* by an action of a helical groove 138*c* and also the transported toner T is mixed with a toner accumulated in the lower part of the second end side 138*b*.

Figure 11A:
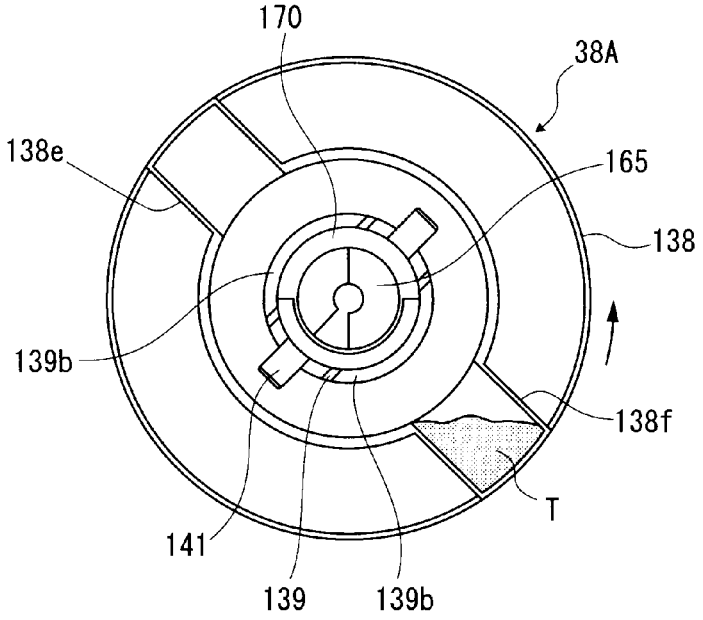
FIG. 11A is a view showing a positional relationship of a supply port and a lift-up section when the powder container shown in FIG. 1A is rotated.
Figure 11B:
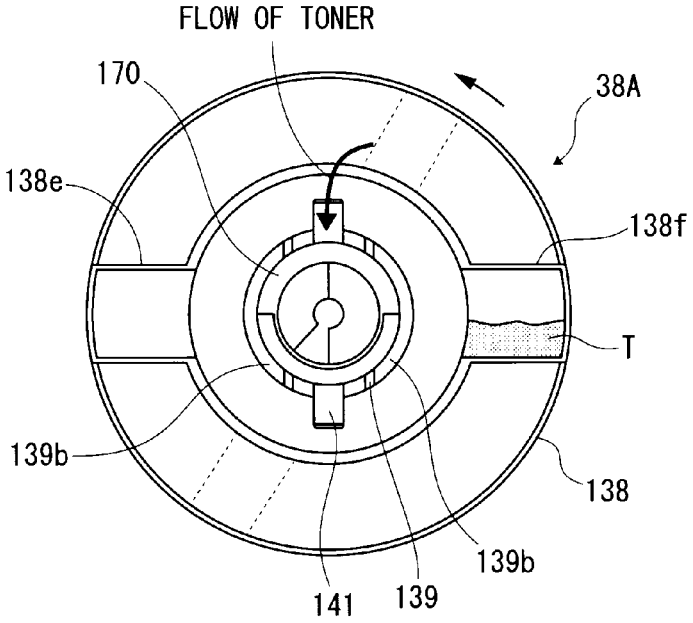
FIG. 11B is a view showing that the supply port which moves as a result of rotation of the powder container is misaligned with a position of a powder receiving inlet.

When the toner container 38A rotates, the supply port 139*b* formed in the nozzle receiver 139 and the lift-up section 138*f* of the container are in a fixed positional relationship. Thus, as shown in FIG. 11A, when the toner container 38A rotates, due to the rotation, the toner T accumulated in the lower part of the container is lifted up in the container by the lift-up section 138*f* and drops on the way. As shown in FIG. 11B, the toner T is supplied into the nozzle section 165 via the powder-receiving inlet 170 when the powder-receiving inlet 170 of the nozzle section 165 almost matches in position the supply port 139*b* which moves circumferentially due to the rotation of the nozzle portion 165 and the powder-receiving inlet 170.

Figure 12A:
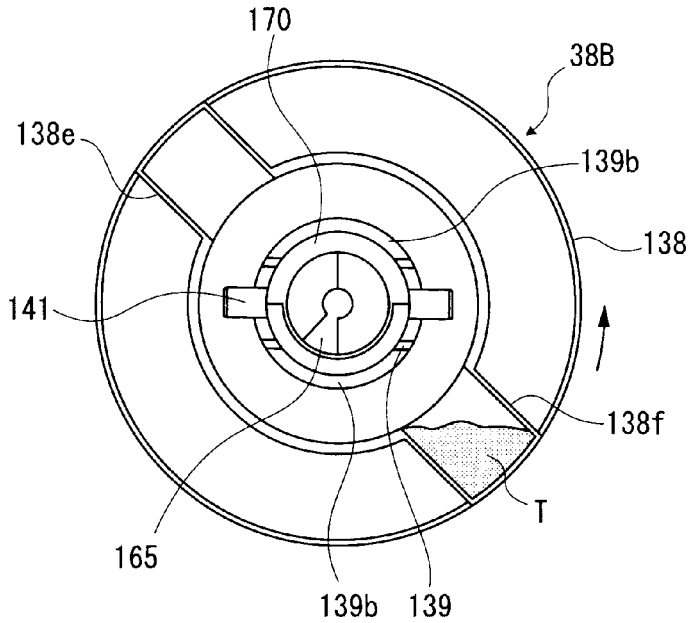
FIG. 12A is a view showing a positional relationship of the supply port, the powder receiving inlet, and the lift-up section when the powder container shown in FIG. 1B is rotated.
Figure 12B:
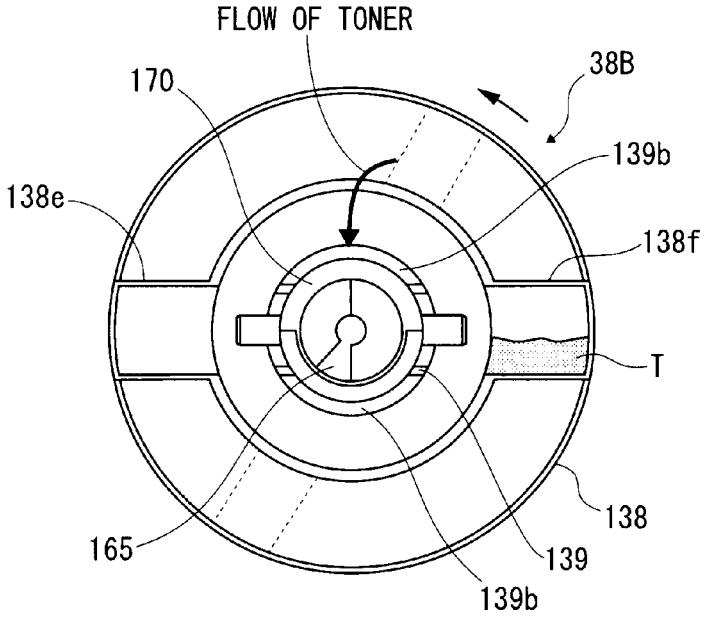
FIG. 12B is a view showing that a toner is supplied to the supply port and the powder receiving inlet when the powder container is rotated.
Figure 13A:
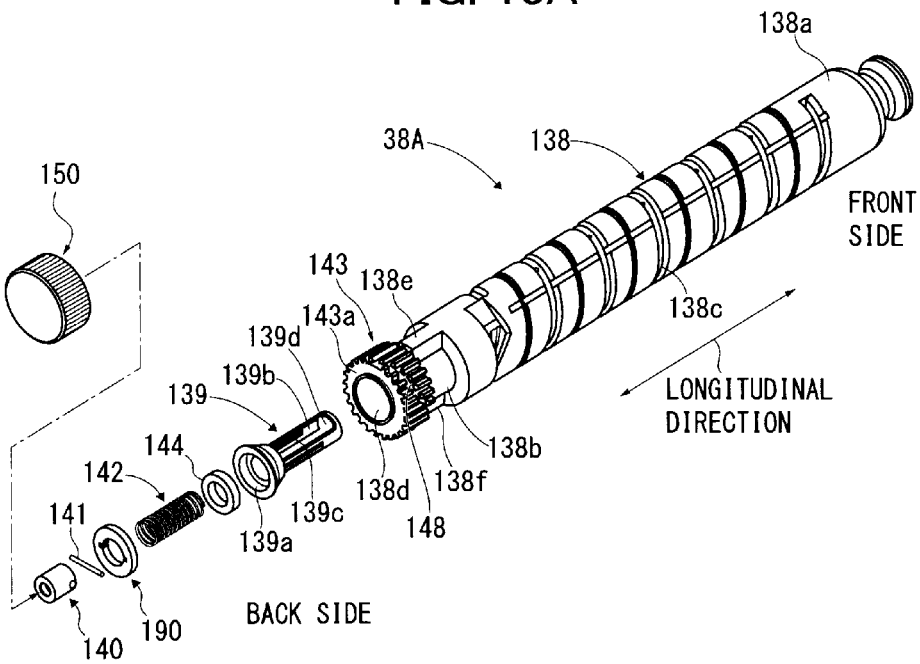
FIG. 13A is an exploded perspective view showing one embodiment of the powder container according to the present invention including a loosening member and a cap.
Figure 13B:
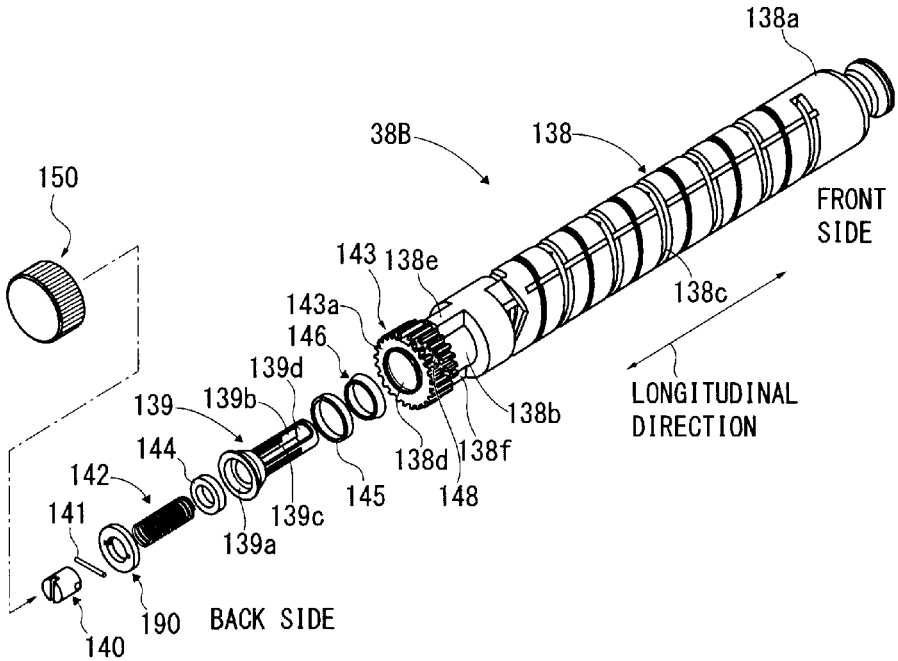
FIG. 13B is an exploded perspective view showing another embodiment of the powder container according to the present invention including a loosening member and a cap.
Figure 14A:
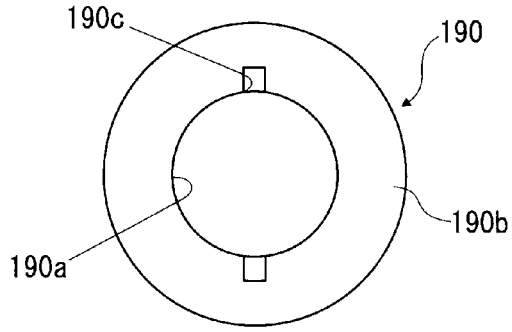
FIG. 14A is a front view showing a configuration of a ring-shaped loosening member.
Figure 14B:
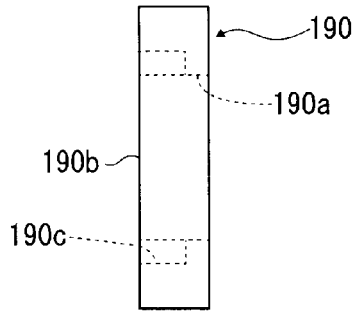
FIG. 14B is a side view of FIG. 14A.
Figure 15A:
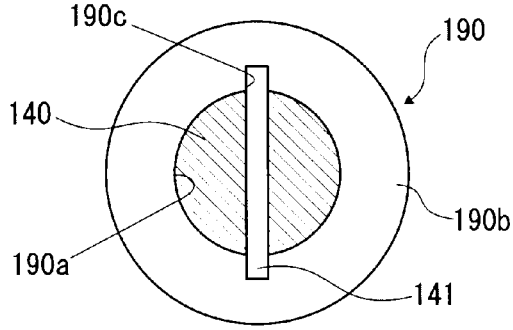
FIG. 15A is a sectional view showing that the ring-shaped loosening member is integrated with a shutter.
Figure 15B:
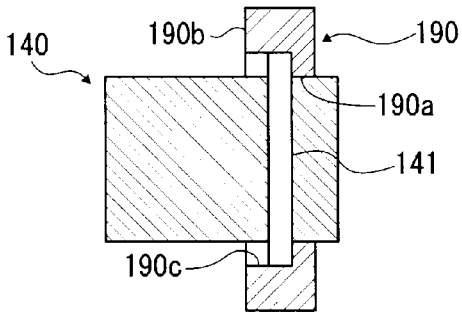
FIG. 15B is a lateral cross-sectional view of FIG. 15A.

When the toner container 38B rotates, the powder-receiving inlet 170 provided in the nozzle section 165 and the supply port 139*b* formed in the nozzle receiver 139 are in a fixed positional relationship. Thus, as shown in FIG. 12A, when the toner container 38A rotates, due to the rotation, the toner T accumulated in the lower part of the container is lifted up in the container alternately by the lift-up section 138*e*, 138*f*, during which, as shown in FIG. 12B, the toner T drops and is supplied into the nozzle section 165 via the supply port 139*b* and the powder-receiving inlet 170.

That is to say, in the case of the toner container 38A, the toner T in the container is supplied into the nozzle section 165 only while the powder-receiving inlet 170 of the nozzle section 165 and the supply port 139*b* of the nozzle receiver 139 overlap in one turn of the container. In the case of the toner container 38B, the toner T in the container is supplied into the nozzle section 165 every time the lift-up sections 138*e*, 138*f* pass over the powder-receiving inlet 170 of the nozzle section 165 and the supply port 139*b* provided in the nozzle receiver 139, positions of which match, in one turn of the container.

The toner T supplied into the nozzle section 165 is transported by the transport screw 167 toward the connection path 166, and drops on the connection path 166. The dropped toner T is fed into the transport path 161 via the sub hopper 163 shown in FIGS. 4, 5, and transported and supplied to the developing device 5 by rotation action of the transport screw 161B.

A toner container 38C, 38D, as a powder container, is made by adding a loosening member 190 for breaking down the toner accumulated near the supply port 139*b* to the toner container 38A, 38B as shown in FIGS. 1A, 1B. As a configuration of the toner container 38C, 38D is the same as the toner container 38A, 38B, except for the loosening member 190, a configuration of the loosening member 190 and action thereby will be mainly described now.

Figure 16:
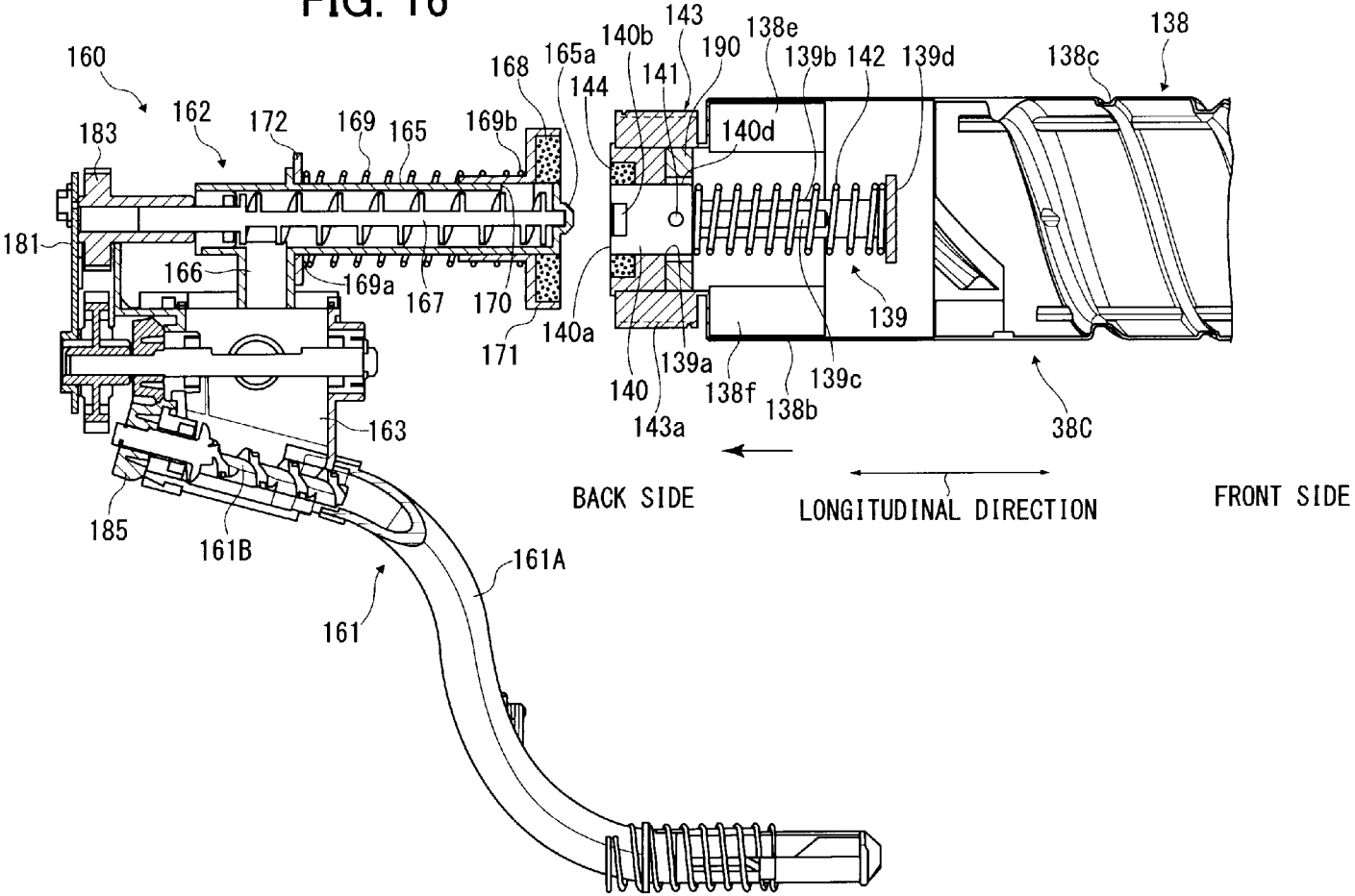
FIG. 16 is a partial cross-sectional view showing a configuration of a powder supply device including a powder container illustrated in FIG. 13A.
Figure 17:
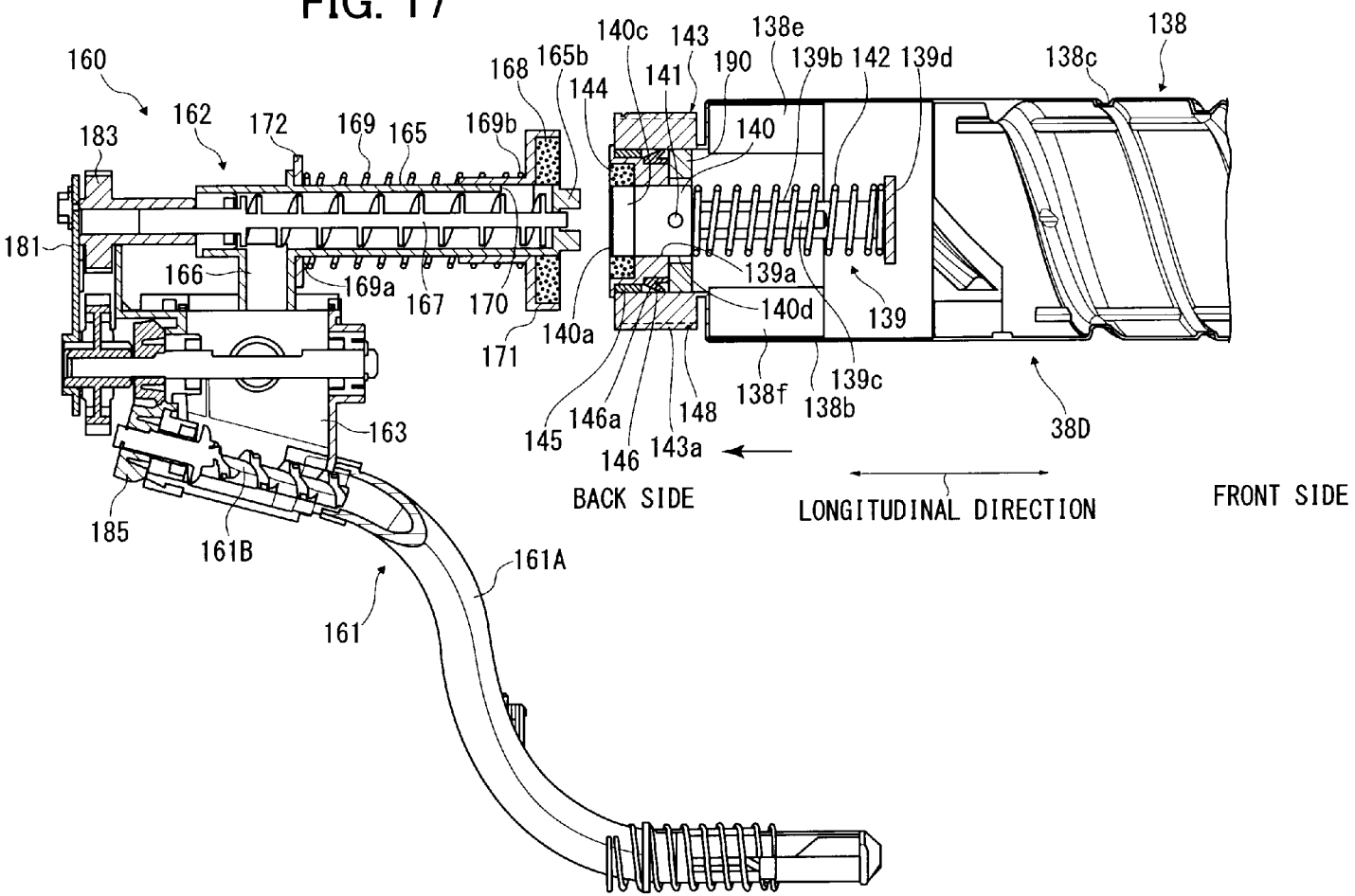
FIG. 17 is a partial cross-sectional view showing a configuration of a powder supply device including a powder container illustrated in FIG. 13B.

As shown in FIGS. 13A-15B, the loosening member 190 is a ring member at the center of which a through-hole 190*a* is formed, and in which a groove 190*c* for fitting to a pin 141 which penetrates a shutter 140 is formed in one lateral face 190*b*. As shown in FIGS. 16, 17, an outer circumferential surface of a nozzle receiver 139 is inserted into the through-hole 190*a*. The pin 141 of the shutter 140 housed inside the nozzle receiver 139 is fitted to the groove 190*c* from the lateral face 190*b* side. With this structure, the loosening member 190 is made movable integrally with the shutter 140 while protruding from the nozzle receiver 139 toward the inside of the toner container.

In summary, the loosening member 190 is a member protruding from the nozzle receiver 139 toward the inside of the container body 138 and configured to be movable in the moving direction of the shutter 140 in conjunction with opening and closing operations of the shutter 140.

Figure 18:
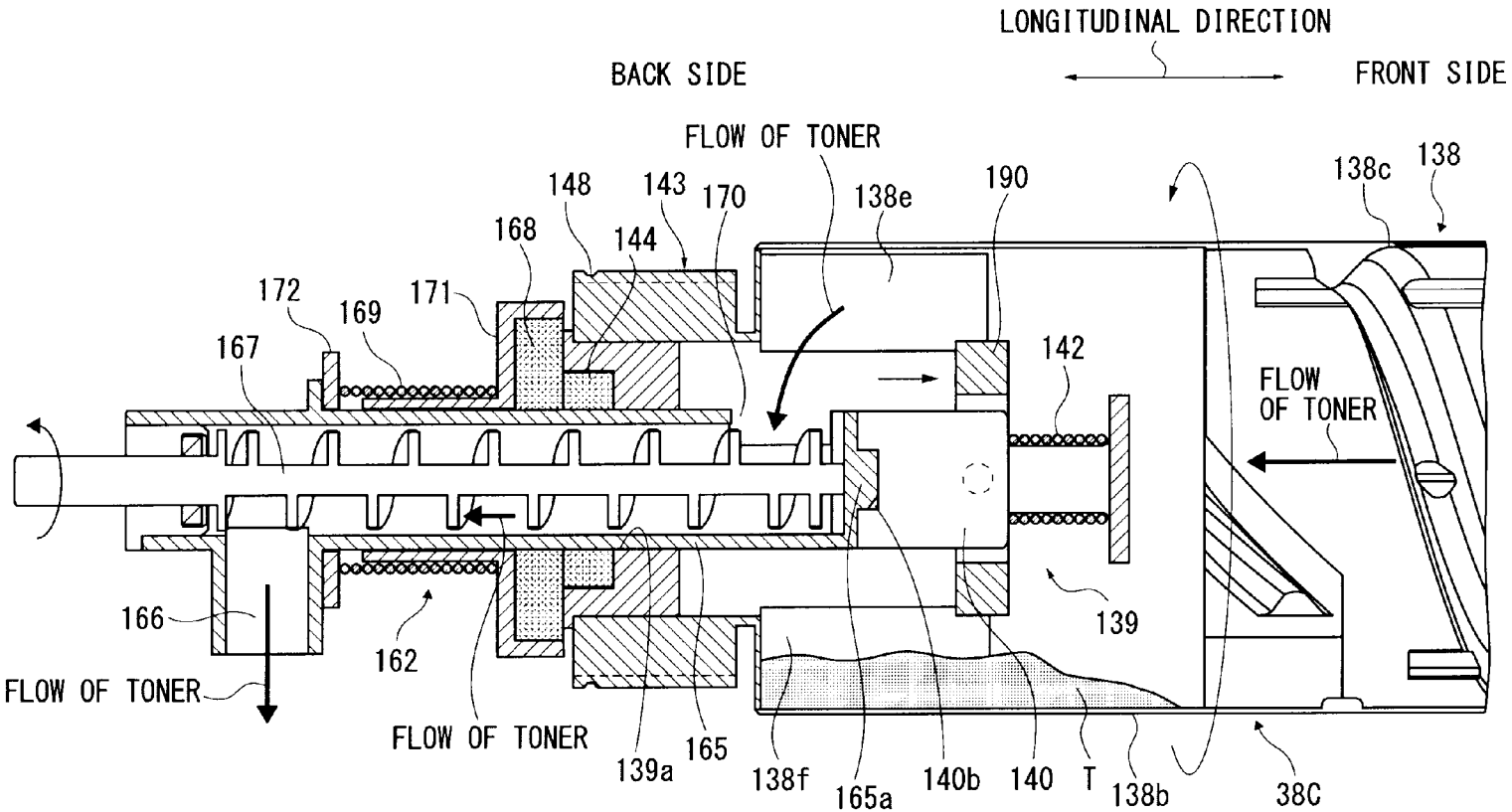
FIG. 18 is an enlarged cross-sectional view showing that the transport nozzle that the powder supply device shown in FIG. 16 includes is attached to the powder container.
Figure 19:
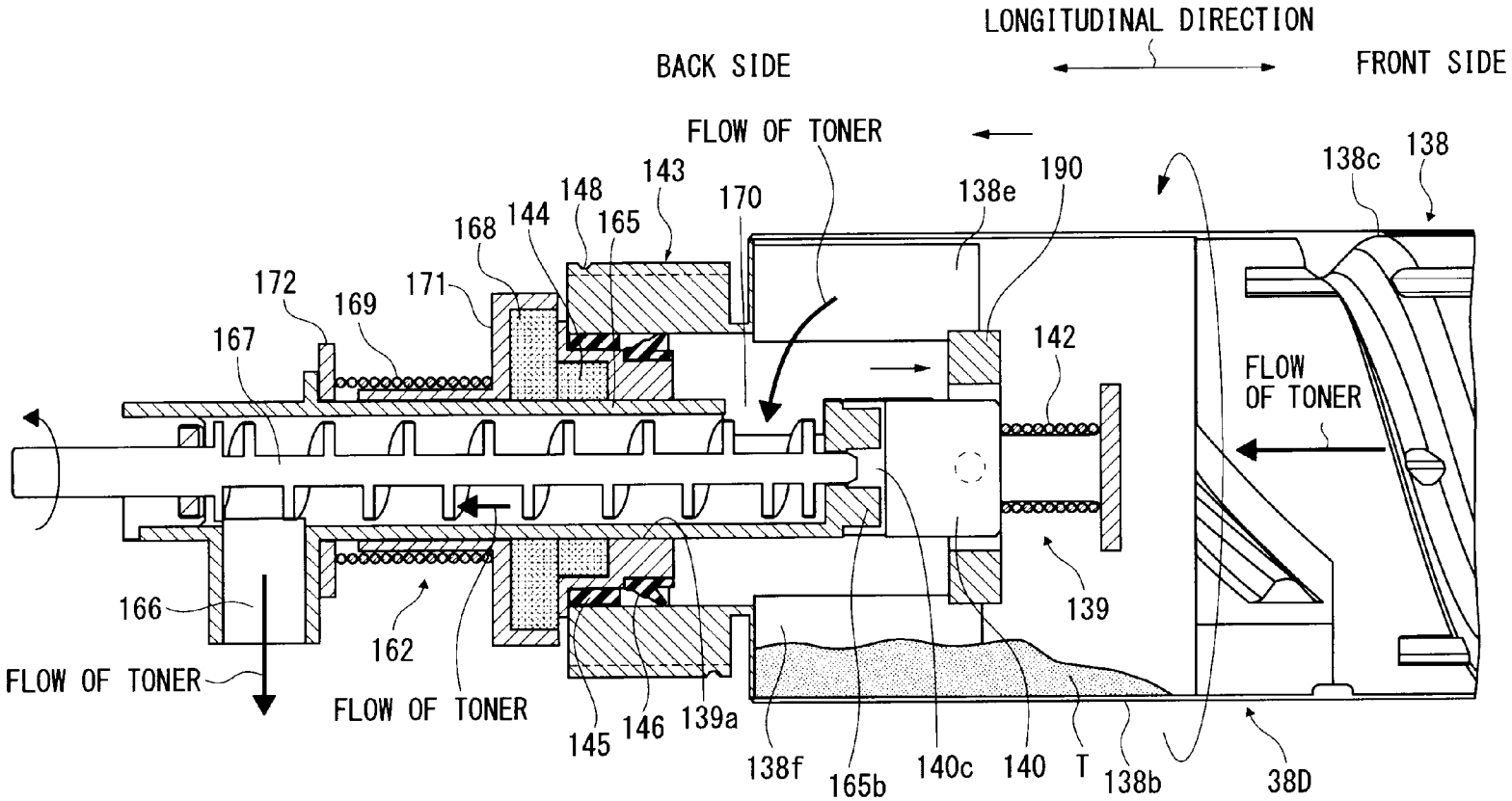
FIG. 19 is an enlarged cross-sectional view showing that the transport nozzle that the powder supply device shown in FIG. 17 includes is attached to the powder container.

The loosening member 190 is mounted to the shutter 140 so as to be arranged on the inner end 140*d* side of the shutter 140. When the shutter 140 occupies the closed position as shown in FIGS. 16, 17, the loosening member 190 occupies a first position between the second end side 138*b* of the container body 138 and the end of the supply port 139*b*. When the shutter 140 occupies the open position as shown in FIGS. 18, 19, the loosening member 190 occupies a second position between the first end side 138*a* of the container body 138 and the supply port 139*b*. Specifically, the loosening member 190 moves to and from the first and second positions with movement of the shutter 140.

With the configuration provided with such a loosening member 190, as shown in FIGS. 18, 19, a space can be secured more easily around the supply port 139*b*, by the action of pushing away any toner accumulated near the supply port 139*b* as a result of sliding of the shutter 140, breaking down any toner accumulated near the supply port 139*b* as a result of movement of the loosening member 190, and rubbing through the toner accumulated near the supply port 139*b*, more specifically, on the nozzle receiver 139. This enables reliable supply of the toner from the supply port 139*b* to the powder-receiving inlet 170. Thus, powder contained in the toner container 38C, 38D can be reliably discharged to the outside of the container, while preventing the powder from spilling and flying from the container.

Figure 20A:
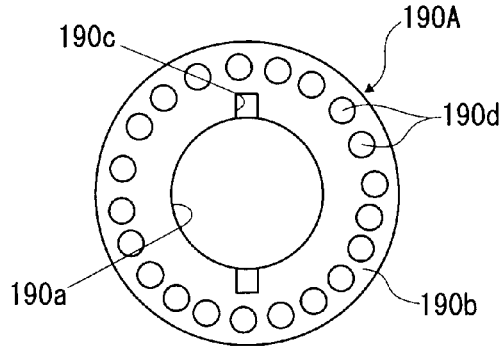
FIG. 20A is a front view showing an embodiment of a loosening member having a plurality of openings.
Figure 20B:
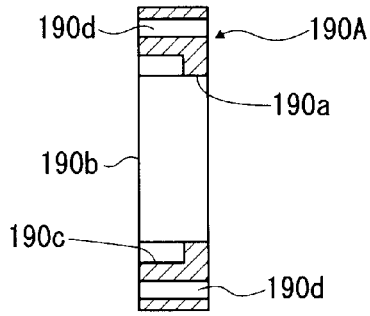
FIG. 20B is a side cross-sectional view of FIG. 20A.
Figure 21A:
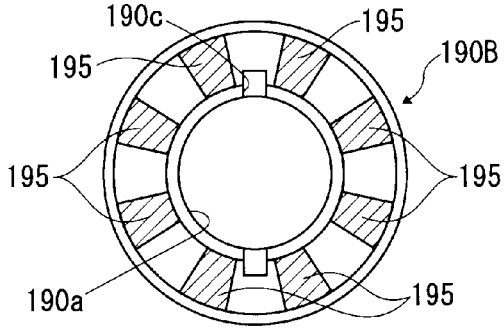
FIG. 21A is a front view showing an embodiment of a loosening member formed of a vane member.
Figure 21B:
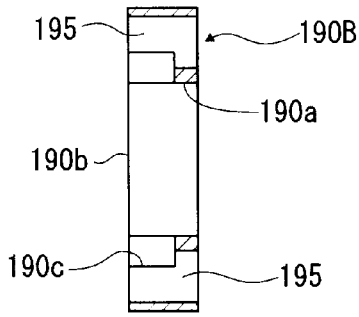
FIG. 21B is a side cross-sectional view of FIG. 21A.

Since the loosening member 190 as shown in FIGS. 13A-15B is a ring member, it is expected that sliding resistance when the loosening member rubs through a toner increases, if it slides in the longitudinal direction of the nozzle receiver 139 as the shutter 140 moves. Thus, as shown in FIGS. 20A, 20B, for example, the loosening member may be a loosening member 190A having an opening 190*d* which penetrates in its own moving direction. In this case, the number and area of the opening 190*d* may vary depending on the sliding resistance. For example, if sliding resistance while the shutter 140 moves is large, the opening area may be increased. If the sliding resistance is small, no opening 190*d* may be formed or the opening area may be reduced. As shown in FIGS. 20A, 20B, as a method for adjusting the opening area, multiple openings 190*d* may be formed or a not shown one opening 190*d* is formed and the size of the opening 190*d* is changed.

Figure 22A:
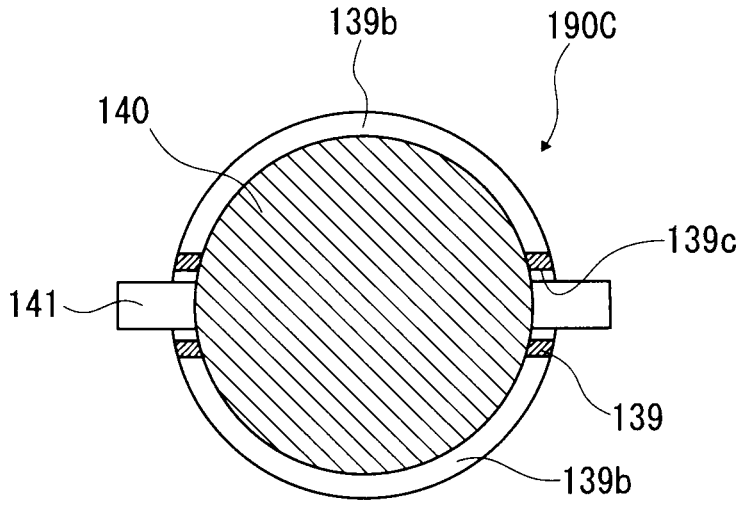
FIG. 22A is a cross-sectional view showing one embodiment in which a loosening member is configured by a pin which supports a shutter to a nozzle receiver.
Figure 22B:
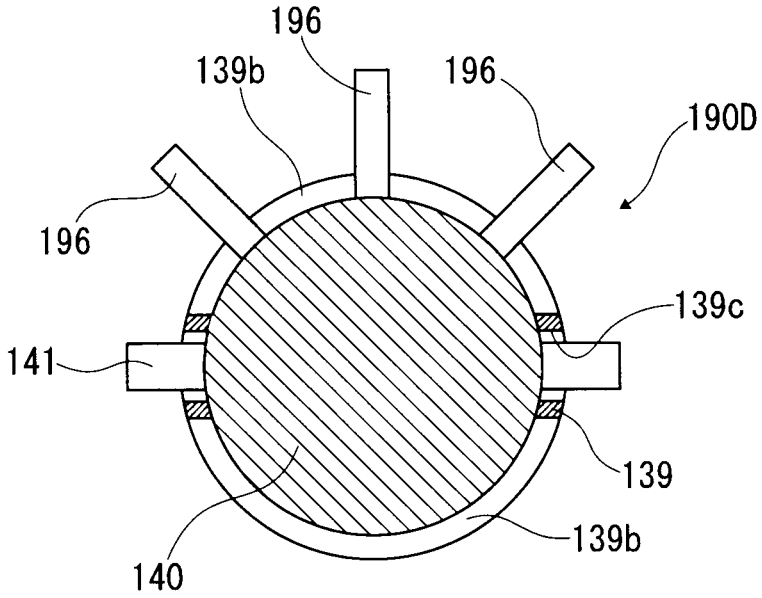
FIG. 22B is a cross-sectional view showing an embodiment in which the loosening member is configured by a pin provided in the shutter.

A form of the loosening member shall not be limited to a ring shape. For example, it may be a loosening member 190B, as shown in FIGS. 20A, 20B, configured to have multiple vane members 195 spaced in a circumferential direction, a loosening member 190C, as shown in FIG. 22A, configured to have the pin 141 protruded toward the inside of the container from the surface of the nozzle receiver 139 by extending the total length of the pin 141, or a loosening member 190D, as shown in FIG. 22B, configured by one or more pin 196 which protrudes from the surface of the shutter 140 more into the container than to the surface of the nozzle receiver 139. The form of the loosening members may be selected and defined as appropriate, depending on the sliding resistance while the shutter 140 slides, the inside shape of the toner container, or toner flow characteristics.

Figure 23A:
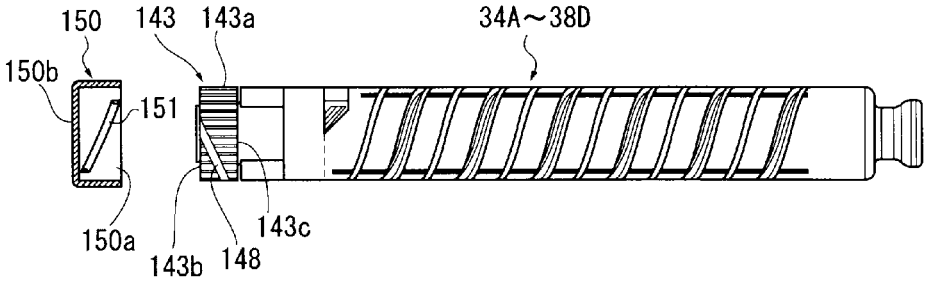
FIG. 23A is a view showing the configuration of the cap and the configuration of the powder container and showing that the cap is separated from the powder container.

The configurations of the gear 143 and the cap 150 will be described with reference to FIGS. 23A-23C. In addition, in the following figures, the reference numerals, Y, M, C, K for identifying colors of toners may be omitted for the elements having the same functions. As illustrated in FIG. 23A, the above-described toner container 38A-38D includes the cap 150 which is detachable to the gear 143 at the time of storage and transportation before mounting on the toner container housing section 31. The cap 150 includes an elastic deformable resin tubular body 150*a* and a convex section 151 formed inward in the inner surface of the tubular body 150*a*. The inner surface of the tubular body 150*a* is formed to be larger than the outer diameter of the gear 143. The tubular body 150*a* is made of a tubular member having a side surface 150*b* opposed to an end surface 143*b* of the gear 143 made of a spur gear. The width of the tubular body 150*a* in the longitudinal direction is set to be a length which covers the entire gear 143 when the cap 150 is mounted on the gear 143. The tubular body 150*a* and the convex section 151 are integrally formed. The convex section 151 according to the present embodiment is formed as a spiral protrusion The tooth sections 143*a* of the gear 143 include a groove 148 which engages with the convex section 151 when the cap 150 is mounted on the gear 143. The groove 148 is a spiral groove having a pitch which is the same as that of the convex section 51 such that the spiral convex section 151 can move from a first end surface 143*b* to a second end face 143*c* of the gear 143.

Figure 23B:
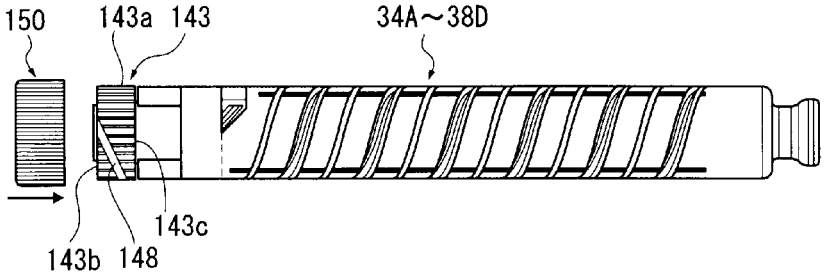
FIG. 23B is a view showing that the cap comes closer to the gear.
Figure 23C:
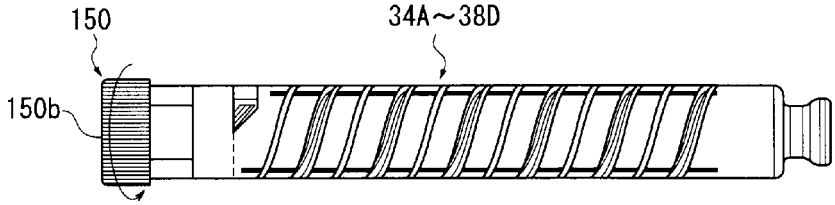
FIG. 23C is a view showing that the cap is mounted on the gear.

The separated cap 150 formed separately from the toner container 38A-38D as shown in FIG. 23A is brought closer to the gear 143 as shown in FIG. 23B. After that, if the cap 150 is rotated in the arrow direction shown in FIG. 23C, the convex section 151 enters in the groove 148 to be threadably mounted on the groove in a position where the spiral convex section 151 and the groove 148 are aligned, so that the cap 150 is mounted on the gear 143 to cover the tooth sections 143*a*, and the cap 150 and the gear 143 are thereby fastened.

As described above, since the cap 150 which is mounted on the gear to cover at least the tooth sections 143*a* of the gear 143 formed in the toner container 38A-38D from the entire circumferential direction is provided, the gear 143 and the tooth sections 143*a* of the toner container 38A-38D can be prevented from being damaged with the simple configuration of the spiral convex portion 151 and the groove 148 without increasing the length of the cap 150 in the longitudinal direction of the toner container.

Figure 24:
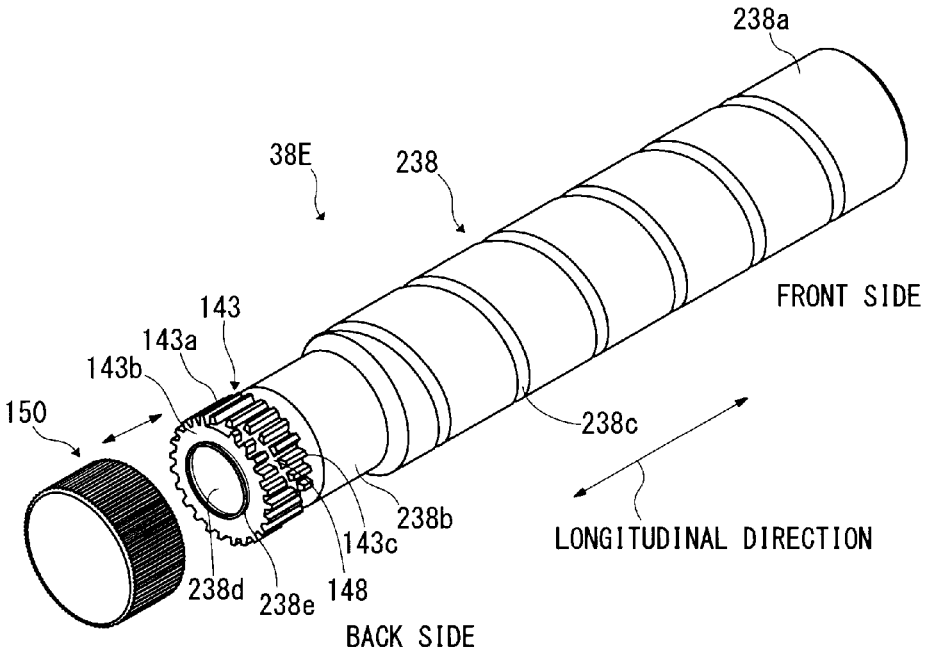
FIG. 24 is a perspective view showing the configuration of the cap and the configuration of another powder container, and showing that the cap is separated from the powder container.
Figure 25A:
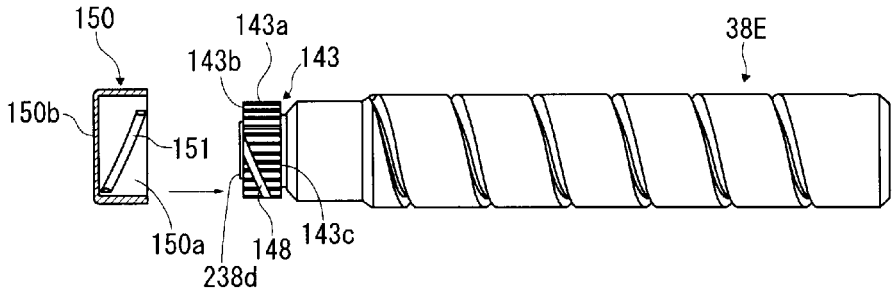
FIG. 25A is a view showing the configuration of the cap and the powder container shown in FIG. 24, and showing that the cap is separated from the powder container.
Figure 25B:
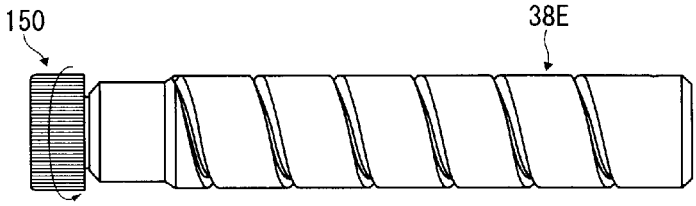
FIG. 25B is a view showing that the cap is mounted on the gear.

FIGS. 24, 25A, 25B show a toner container 38E as a powder container, which is different from the toner container 38A-38D. The toner container 38E includes a container body 238 which stores inside thereof a toner, the gear 143 formed in the container body 238 and the cap 150 which is mounted on the gear to cover at least the tooth sections 143*a* of the gear 143 from the entire circumferential direction.

The tubular container body 238 includes on the circumferential face thereof a spiral protrusion 238*c* which protrudes toward the container inside from a first end side 238*a* to a second end side 238*b*. The tubular container body 238 is configured to carry the toner housed inside the toner container 38E from the first end side 238*a* to the second end side 238*b* by the rotation of the container body 238. An end face 238*e* of the second end side 238*b* of the container body 238 includes a toner outlet 238*b* which discharges the carried toner outside.

Such a toner container 38E includes the cap 150 having the convex section 151 as a spiral protrusion, which is detachable to the gear 143 at the time of storage or transportation before the toner container 38E is mounted on the toner container housing section 31.

In this embodiment, the tooth sections 143*a* of the gear 143 include the spiral groove 148 which engages with the convex section 151 when the cap 150 is mounted on the gear 143.

The separated cap 150 which is formed separately from the toner container 38E is brought closer to the gear 143 as illustrated in FIG. 25A. After that, if the cap 150 is rotated in the arrow direction illustrated in FIG. 25B, the convex section 151 enters in the groove 148 to be threadably mounted on the gear 143 in a position where the spiral convex portion 151 is aligned with the groove 148, and the cap 150 is mounted on the gear 143 to cover the tooth sections 143 so that the cap 150 and the gear 143 are fastened. In this mounted state, since the side face 150*b* of the cap 150 covers the toner outlet 238*d*, the toner outlet 238*d* is sealed, and the spilling out of the toner can be prevented while protecting the gear 143. In order to further reduce the spilling out of the toner, a sealing member such as a sponge is arranged in the side face 150*b* to improve the adhesiveness of the toner outlet 238*d* and the side face 150*b*.

As described above, since the cap 150 which is mounted on the gear to cover at least the tooth sections 143*a* of the gear 143 formed in the toner container 38E from the entire circumferential direction is provided, the gear 143 and the tooth sections 143*a* of the toner container 38E can be prevented from being damaged with the simple configuration of the spiral convex section 151 and groove 148 without increasing the length of the cap 150 in the longitudinal direction of the toner container 38E.

As the toner container 38E, a toner container having the toner outlet 238*d* on the second end side 238*b* of the container body 238 is illustrated. However, a not shown known opening and closing valve, which closes the toner outlet 238*d* when the toner container 38E is separated from the toner container housing section 31 and opens the toner outlet 238*d* when the toner container 38E is mounted on the toner container housing section 31, can be disposed inside the second end side 238*b*. Alternatively, a not shown known stopper, which closes the toner outlet 238*d* when the toner container is separated from the toner container housing section 31 and opens the toner outlet 238*d* when the toner container is mounted on the toner container housing section 31, can be used.

In the above embodiment, the one groove 148 is illustrated, but the number of grooves 148 is not limited to one. Two or more grooves 148 can be provided as long as there is no problem for rotationally driving the toner container 38A-38E with the gear 184 which meshes with the gear 143.

Next, the modified examples of the cap and the gear will be sequentially described. As the powder container to which the modified examples of the cap and the gear are applied, the toner container 38E shown in FIG. 24 is described, but the modified examples of the cap and the gear can be mainly applied to the toner containers 38A-38D illustrated in FIGS. 1A-13B, and the effects similar to those in the toner container 38E can be obtained.

MODIFIED EXAMPLE 1

Figure 26:
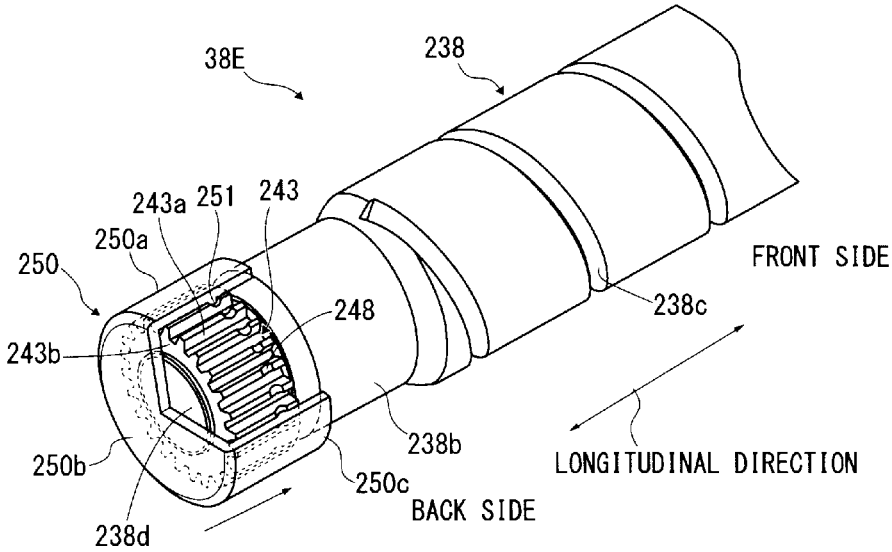
FIG. 26 is an enlarged perspective view showing another embodiment of a gear and a cap, and showing that the cap is mounted.
Figure 27:
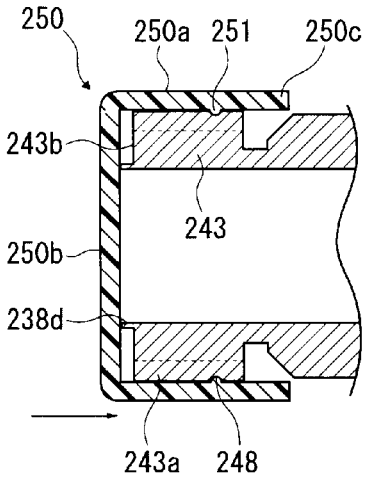
FIG. 27 is an enlarged sectional view showing that the cap shown in FIG. 26 is mounted.

As shown in FIGS. 26, 27, a gear 243 having on the entire circumference thereof tooth sections 234*a* is provided in the second end side 238*b* of the container body 238 of the toner container 38E. The gear 243 has on the entire circumference thereof cutout sections 248 each having a semicircular shape in section as grooves in the same portions of the respective tooth sections 234. A cap 250 is mounted on the gear 243 to cover at least the tooth sections 243*a* from the entire circumferential direction.

The cap 250 is mounted on the gear 243 at the time of storage or transportation before the toner container 38E is mounted on the toner container housing section 31, and is separated from the gear 243 at the time of mounting the toner container on the toner container housing section 31. The cap 250 includes an elastic deformable resin tubular body 250*a* and a convex section 251 having a semicircular shape in section, which is formed toward the inward side of the tubular body in the inner circumferential face of the tubular body 250*a*. The convex section 251 is locked by the cutout sections 248 when the cap 250 is mounted on the gear 243. Namely, the cutout sections 248 engage with the convex section 251. The tubular body 250*a* has on the side opposed to the toner outlet 238*b* a side face 250*b* which seals the toner outlet 238*d* when the cap 250 is mounted on the gear 243. This side face 250*b* is configured to seal the toner outlet 238*d*.

According to the above-described configuration, if the cap 250 is provided from the end face 243*b* side of the gear 243, the convex section 251 hits the leading end of the tooth sections 243*a*, and elastically deforms such that the cap 250 expands in the outer diameter direction from the opening end 250*c* side. Then, if the convex section 251 enters into the cutout sections 248 of the gear 243, the elastic deformation of the cap 250 is released, and the cap 250 is mounted on the gear 243 to cover the tooth sections 243*a*, so that the cap 250 and the gear 243 are fastened.

As described above, since the cap 250 which is mounted on the gear 243 to cover at least the tooth sections 243*a* of the gear 243 formed in the toner container 38E from the entire circumferential direction is provided, the gear 243 and the tooth sections 243*a* of the toner container 38E can be prevented from being damaged with the simple configuration of the convex section 251 and the cutout sections 248 without increasing the length of the cap 250 in the longitudinal direction of the toner container.

MODIFIED EXAMPLE 2

Figure 28:
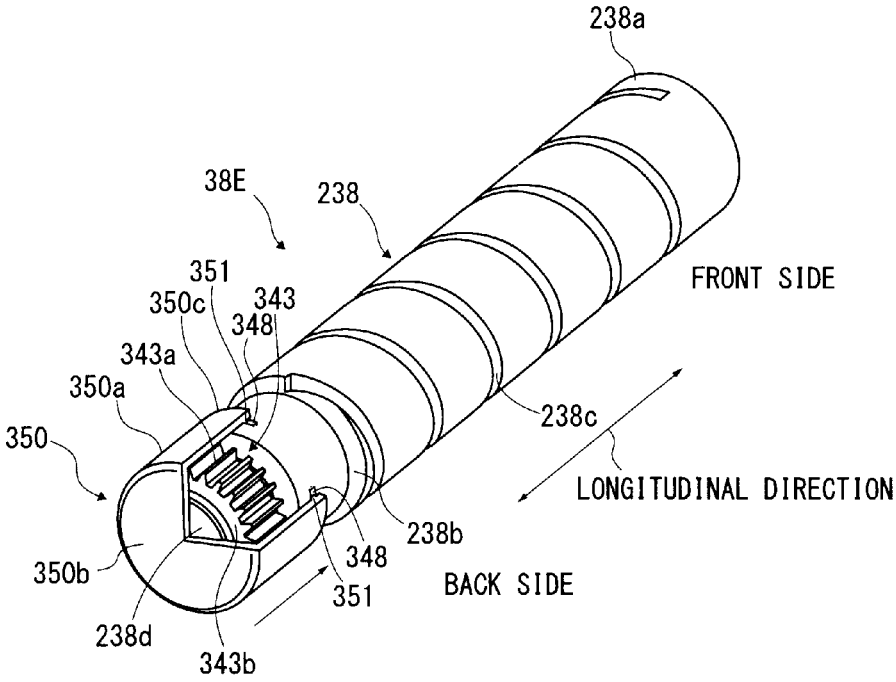
FIG. 28 is a partially broken-out perspective view showing another embodiment of a cap, and showing that the cap is mounted.
Figure 29:
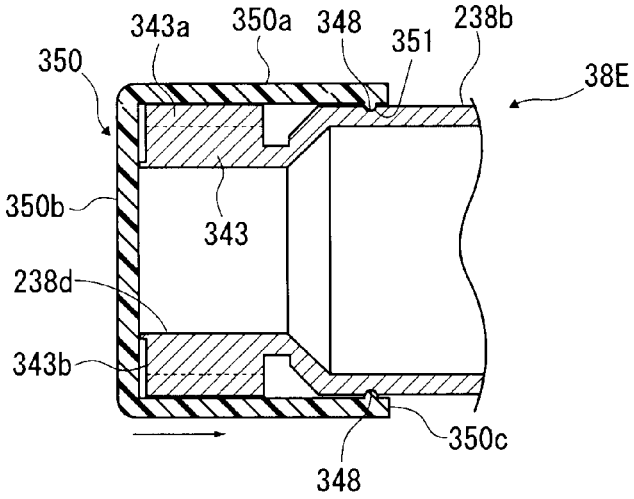
FIG. 29 is an enlarged sectional view showing that the cap shown in FIG. 28 is mounted.
Figure 30A:
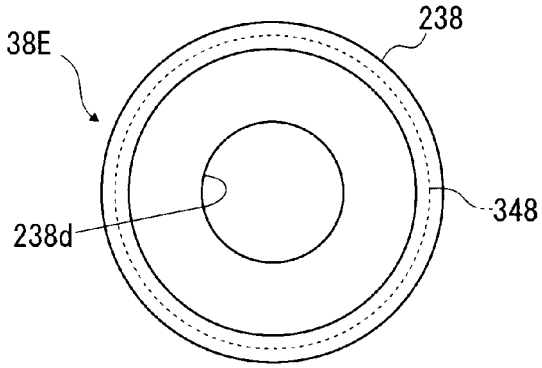
FIG. 30A is a view showing a configuration of a circumferential groove formed in the gear.
Figure 30B:
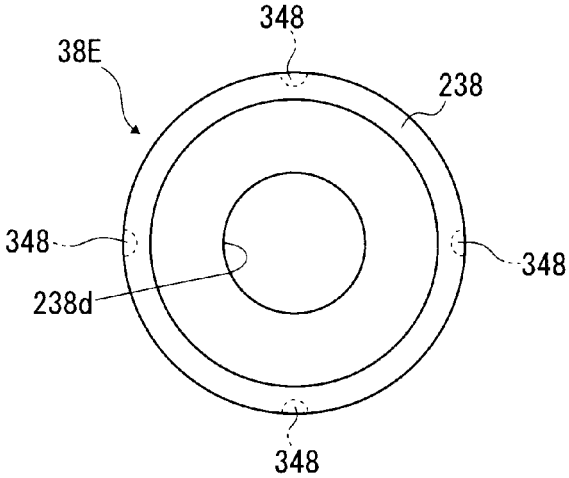
FIG. 30B is a view showing a configuration of a plurality of grooves formed in the gear.

As illustrated in FIGS. 28, 29, 30A, 30B, a gear 343 having on the entire circumference thereof tooth sections 343*a* is formed in the second end side 238*b* of the container body 238 of the toner container 38E. In this example, a groove 348 having a semicircular shape in section is formed in the outer circumferential surface of the container body 238 closer to the central area than the gear 343 instead of forming the groove in the entire circumference of the gear 343. As illustrated in FIG. 30A, as the groove 348, a groove which continues over the entire circumference of the outer circumference of the container body 238 can be used, but grooves formed in four positions with the phase of 90° as illustrated in FIG. 30B is used in this example. A cap 350 is mounted on the gear 343 to cover at least the tooth sections 343*a* from the entire circumferential direction.

As illustrated in FIGS. 28, 29, the cap 350 is mounted on the gear 343 at the time of storage or transportation before the toner container 38E is mounted on the toner container housing section 31, and is separated from the gear 343 at the time of mounting the toner container 38E to the toner container housing section 31. The cap 350 includes an elastic resin tubular body 350*a* and a convex section 351 having a semicircular shape in section, which is formed toward the inward side of the tubular body in the inner circumferential face on the opening end 350*c* side of the tubular body 350*a*. The convex section 351 has a length which reaches the groove 348 on the second end side 238*b* of the container body 238, and is inserted in the groove 348 to be locked when the cap 350 is mounted on the gear 343. Namely, the groove section 343 engages with the convex section 351. The tubular body 350*a* has on the side opposed to the toner outlet 238*d* a side face 350*b* which seals the toner outlet 238*d* when the cap 350 is mounted on the gear 343. This side face 350*b* is configured to seal the toner outlet 238*d*.

According to the above-described configuration, if the cap 350 is provided from the end face 343*b* side of the gear 343, the convex section 351 hits the leading end of the tooth sections 343*a*, and elastically deforms such that the cap 350 expands in the outer diameter direction from the side of the opening end 350*c*. Then, if the convex section 351 enters into the groove 348 via the gear 343, the elastic deformation of the cap 350 is released, and the cap 350 and the container body 238 are fastened in a state in which the cap 350 covers the gear 343.

As described above, since the cap 350 which is mounted on the gear 343 to cover at least the tooth sections 343*a* of the gear 343 formed in the toner container 38E from the entire circumferential direction is provided, the gear 343 and the tooth sections 343*a* of the toner container 38E can be prevented from being damaged with the simple configuration of the convex section 351 and the groove 348 without increasing the length of the cap 350 in the longitudinal direction of the toner container 38E.

MODIFIED EXAMPLE 3

Figure 31:
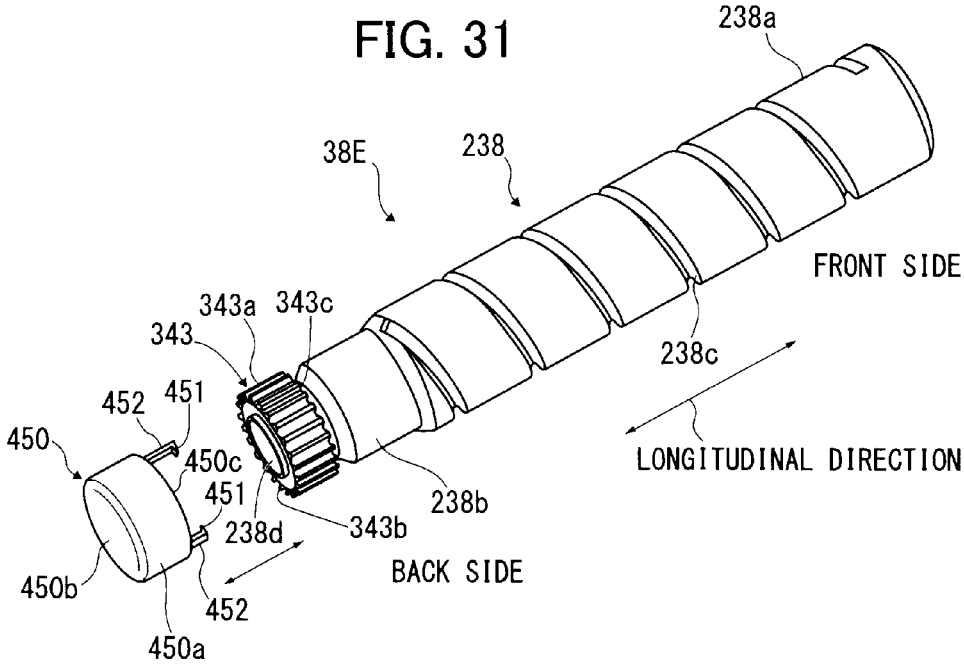
FIG. 31 is a perspective view showing a cap according to another embodiment, and showing that the cap is separated.
Figure 32A:
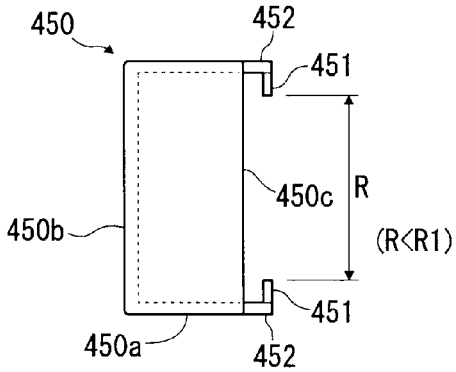
FIG. 32A is a side view of the cap shown in FIG. 31.
Figure 32B:
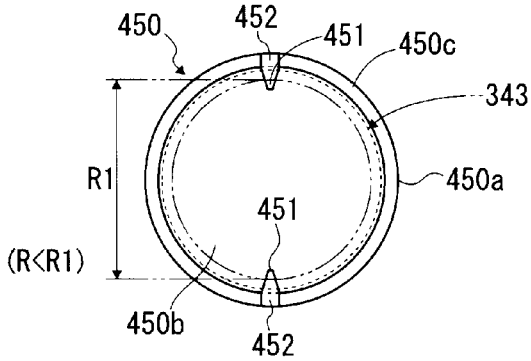
FIG. 32B is a front view of the cap shown in FIG. 31.
Figure 33:
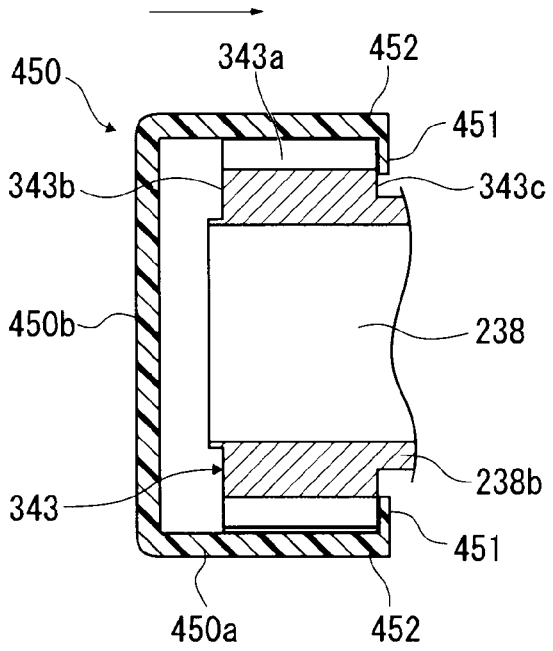
FIG. 33 is an enlarged sectional view showing that the cap shown in FIG. 31 is mounted.
Figure 34:
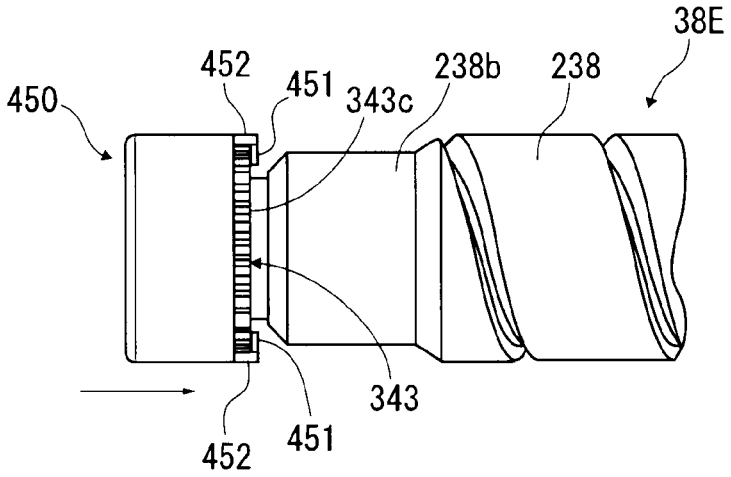
FIG. 34 is an enlarged view showing that the cap shown in FIG. 31 is mounted.

As illustrated in FIGS. 31, 32A, 32B, the gear 343 having on the entire circumference thereof the tooth sections 343*a* is formed in the second end side 238*b* of the container body 238 of the toner container 38E. A cap 450 is mounted on the gear 343 to cover at least the tooth sections 343*a* from the entire circumference direction.

The cap 450 includes an elastic deformable resin tubular body 450*a* and a plurality of click sections 451 which is formed toward the inward side of the body in the opening end 450*c* of the end portion of the tubular body 450*a*, and engages with the end face 343*c* of the gear 343 when the cap 450 is mounted on the gear 343. The click section 451 includes an arm section 452 extending in the longitudinal direction from the opening end 450*c*, and is formed to bend toward the inward side of the body from the leading end of the arm portion 452. The click sections 451 and arm portions 452 are formed integrally with the cap 450, and the arm sections 452 bend inside and outside the cap 450 by the elastic deformation. In this example, the two arm portions 452 are formed in the cap 450 with the phase of 180° to be opposed to one another.

As illustrated in FIGS. 32A, 32B, the distance (diameter direction) R between the leading ends of the two click sections 451 is formed to be smaller than the diameter R1 of the tooth roots of the gear 343 (R<R1). The click section 451 is formed to have a taper shape as seen from the diameter direction, is formed to be a shape which is smaller than the shape between the tooth section 343*a* and the tooth section 343*a* of the gear 343, and is formed to be a shape which can pass through between the tooth section 343*a* and the tooth section 343*a* when the cap 450 is mounted on the gear 343.

According to the above-described configuration, if the cap 450 is provided from the end face 343*b* side of the gear 343, and the click sections 451 enter between the tooth sections 343*a* of the gear 343, the arm portions 452 move between the tooth sections while elastically deforming in the outer diameter direction to be expanded by the click sections 451. Then, if the click sections 451 pass between the tooth sections, the elastic deformation of the arm sections 452 elastically deformed to expand in the outer diameter direction is released, the click sections 451 engage with the end face 343*c* of the gear 343, and the cap 450 is mounted on the gear 343 to cover the tooth sections 343*a*, so that the cap 450 and the gear 343 are fastened.

As described above, since the cap 450 which is mounted on the gear 343 to cover at least the tooth sections 343*a* of the gear 343 formed in the toner container 38E from the entire circumferential direction is provided, the gear 343 and the tooth sections 343*a* of the toner container 38E can be prevented from being damaged with the simple configuration of the elastic deformable click sections 451 without increasing the length of the cap 350 in the longitudinal direction of the toner container 38E.

Next, the color incompatibility of the powder container will be described.

Figure 35:
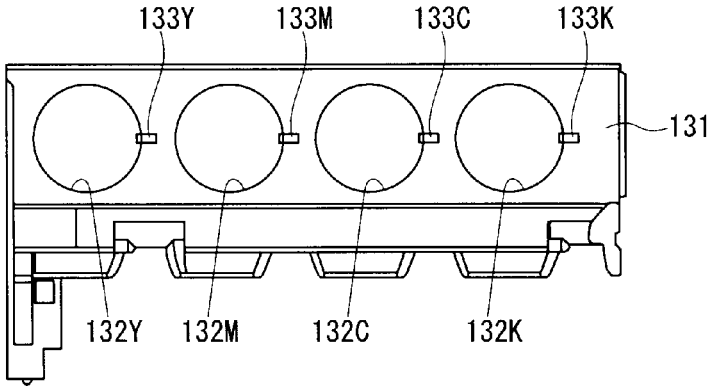
FIG. 35 is a front view showing a configuration of a powder container room in which the powder containers are provided.

FIG. 35 is a view showing the toner container housing section 31 as seen from the front of the image-forming apparatus body 101 shown in FIGS. 1A, 1B. The toner container housing section 31 includes a panel 131 disposed in the front face of the image-forming apparatus body 101. The panel 131 includes openings 132Y, 132M, 132C, 132K to which toner containers are inserted, respectively.

The color image-forming apparatus has a plurality of toner containers corresponding to different colors. Regarding the toner container to be mounted on the toner container housing section 31, the color arrangements corresponding to the image-forming sections are previously defined from the positional relationship with the image-forming sections. For this reason, if the toner containers are not provided in the positions where the colors of the toner containers correspond to the image-forming sections, a different color toner from a different color toner container is supplied to an arbitrary color development device, so that an accurate image can not be output. Therefore, a function which prevents a user from miss-mounting a toner container is often provided by providing a color incompatibility function in the toner containers or the components associated with the toner containers For example, Japanese Patent No. 4384898 describes a configuration which can determine whether or not a correct color toner container is mounted on the toner container housing section in the mounting initial stage by providing an additional component on the toner outlet of the toner container as the color incompatibility function for the purpose of preventing the spilling out of the toner and preventing the miss-mounting of the toner container to the toner container housing section (image-forming apparatus body).

However, in the conventional toner container, since a special incompatibility section is provided, it increases the costs. In the toner container having a driving transfer section such as a gear near the toner outlet, by providing the color incompatibility section outside the toner container, the outer diameter of the driving transfer section such as a gear has to be reduced, so that the rotational driving torque of the toner container is increased, and the driving system of the body is thereby overloaded.

In order to effectively satisfy the color incompatibility function while providing a color incompatibility section without increasing the costs, preventing the increase in the rotational driving torque of the toner container by preventing the reducing in the outer diameter of the driving transfer section such as a gear, the groove 148 formed in the gear 143 provided in the toner container 38A-38E can be used as one method, so that the color incompatibility can be ensured without adding a new member.

Figure 36:
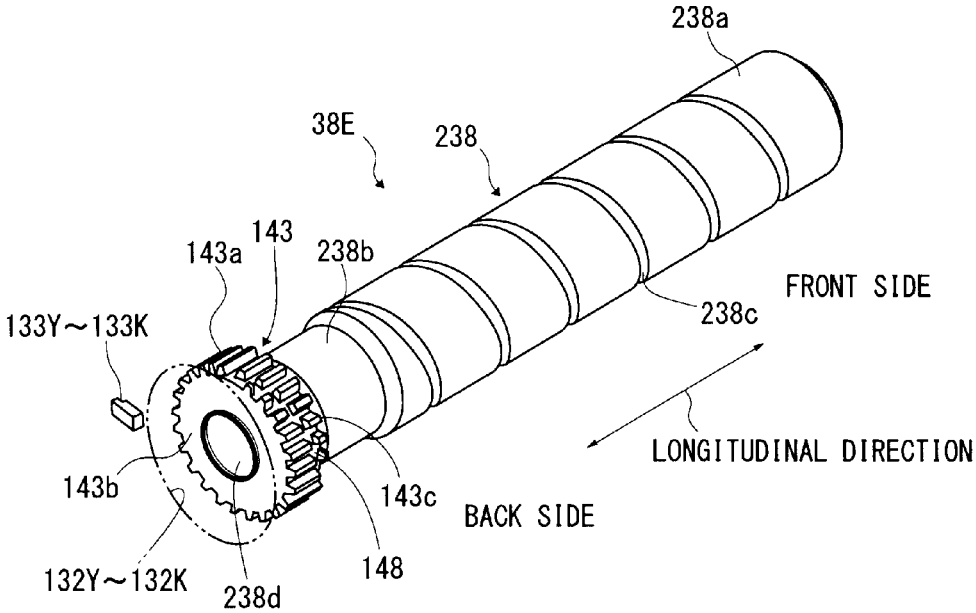
FIG. 36 is a perspective view showing color incompatibility using a groove of a gear and a rib on an opening as a color incompatibility discrimination section.

Moreover, with reference to the example of the toner container 38E shown in FIG. 36, the gear 143 as the driving transfer section provided in the toner container 38E and the groove 148 formed in the gear 143 are used as an identification section of the color incompatibility which determines whether or not the toner container can be mounted on the toner container housing section 31.

As described above, by providing the groove 148 as the identification section in the gear 143 of the driving transfer section, a new special component for color incompatibility becomes unnecessary, and the increase in the costs can be prevented while it becomes unnecessary to reduce the outer diameter of the gear 143 in order to avoid the color incompatibility on the side of the toner container housing section 31, so that the rotational driving torque of the toner container E is increased, and the driving system of the body is not excessively overloaded.

Referring to FIG. 36, the angle of the spiral groove 148 formed in the gear 143 of each color toner container 38E is formed to be an angle different with respect to each toner color. The rib 133Y-133K having an angle, which becomes the color incompatibility section and the mounted section, is provided near the opening 132Y-132K of the toner container housing section 31. Each rib is fastened near each opening 132Y-132K in a state which protrudes in each opening such that the angle of each rib includes an inclined angle in accordance with the groove 148 (Y, M, C, K) corresponding to each color.

As described above, by using the ribs 133Y-133K and the grooves 148 (Y, M, C, K) each having a different angle with respect to each toner color, when a user mounts the toner container 38E on the toner container housing section 31, if the toner container 38E does not correspond to the opening in the predefined position, each rib hits the end face 143*b* of the gear 143, so that the toner container 38E can not be inserted in the opening. Accordingly, the color incompatibility can be ensured with the simple configuration of the grooves 148 (Y, M, C, K) each having a different angle provided in the gears 143 and the ribs (Y-K) each having a different angle provided in the toner container housing section 31. The toner container 38E is mounted on the toner container housing section 31 while aligning each of the ribs 133 (Y, M, C, K) on the side the toner container housing section 31 with each of the spiral grooves 148 (Y, M, C, K) of the gear 143 of each of the toner containers, and the toner container 38E is inserted while rotating. Thus, the toner in the toner container moves in the rotation direction, so that the loosening function can be obtained even if the toner in the container is condensed.

Different from the configuration shown in FIG. 36, if the spiral groove section 148 is formed such that its direction becomes a direction opposite to the toner carrying direction by the spiral protrusion 238*c* formed in the container body 238, the rotation direction of the toner container 38E becomes a direction opposite to the toner carrying direction by the spiral protrusion 238*c* when mounting the toner container 38E on the toner container housing section 31. Accordingly, the toner is brought back in the container when mounting the container; thus, the toner can be effectively prevented from flying from the toner outlet 238*d*.

Figure 37:
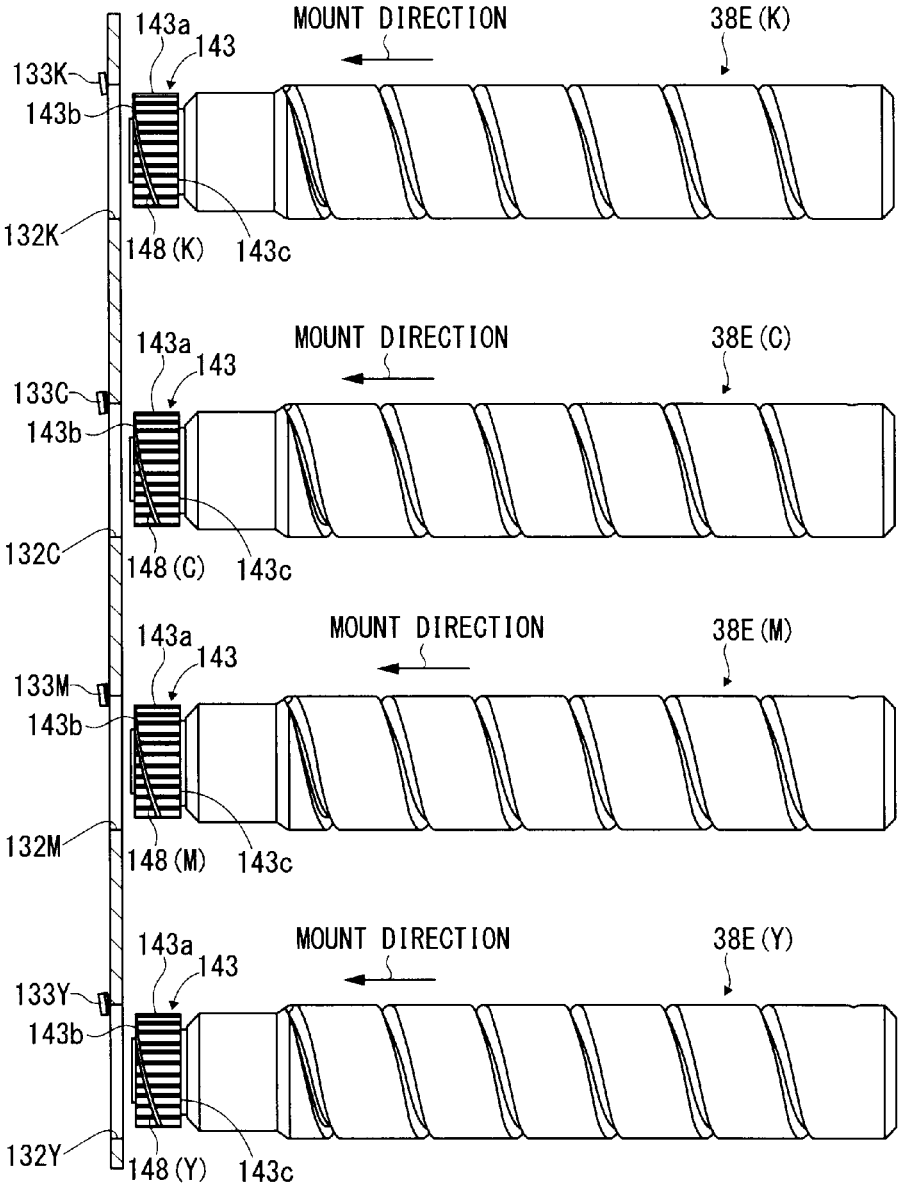
FIG. 37 is a plan view showing that the inclination of the ribs and the inclination of the grooves are changed according to a color of a toner.
Figure 38:
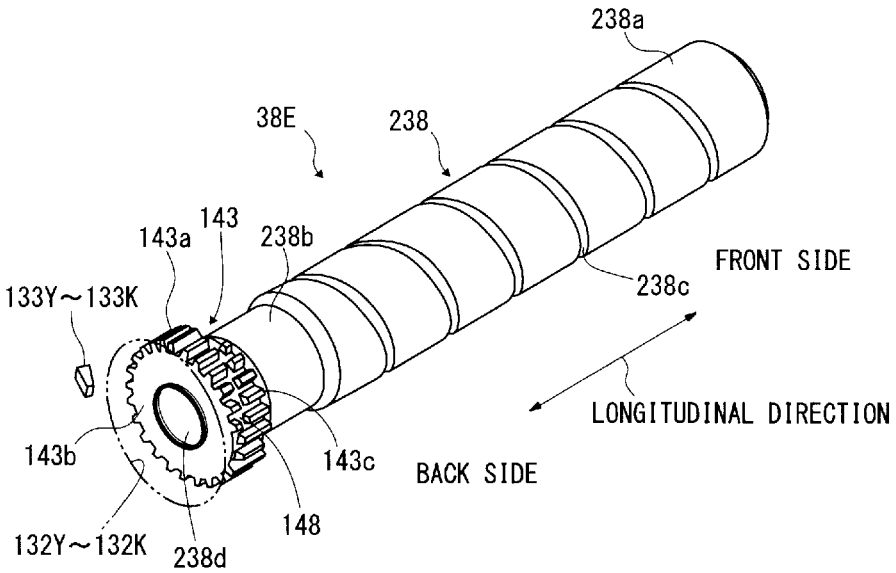
FIG. 38 is a perspective view showing color incompatibility in which the direction of the groove of the gear is reversed from the direction of the groove shown in FIG. 36.
Figure 39:
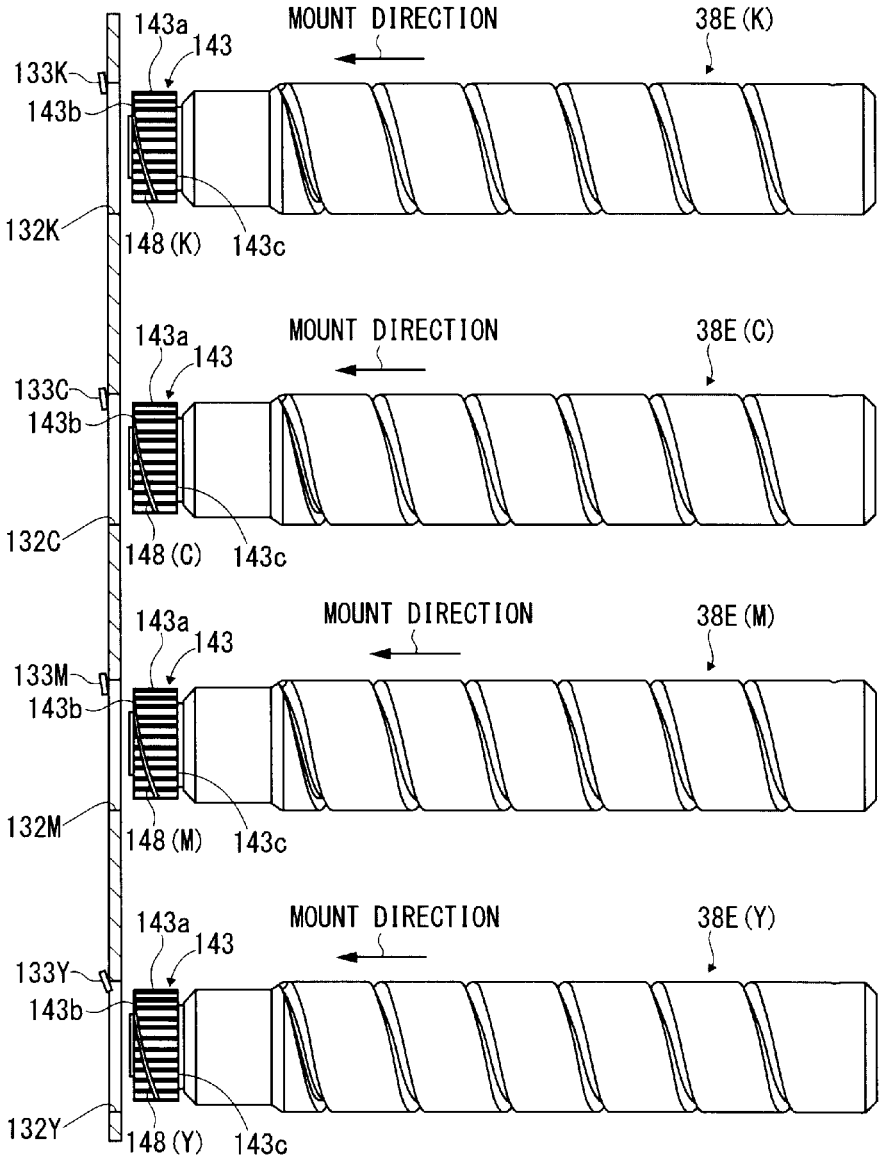
FIG. 39 is a plan view showing another embodiment in which the inclination of the ribs and the inclination of the grooves are changed according to a color of a toner.

In this embodiment, regarding the angles of the ribs 133 (Y, M, C, K) and the grooves 148 (Y, M, C, K), the angles in the direction which inclines to the mount direction in the planar view are changed with respect to the respective toner colors as illustrated in FIG. 37. However the angles in the direction which reciprocates to the mount direction in the planar view can be changed with respect to the respective toner colors as shown in FIG. 39.

Figure 40:
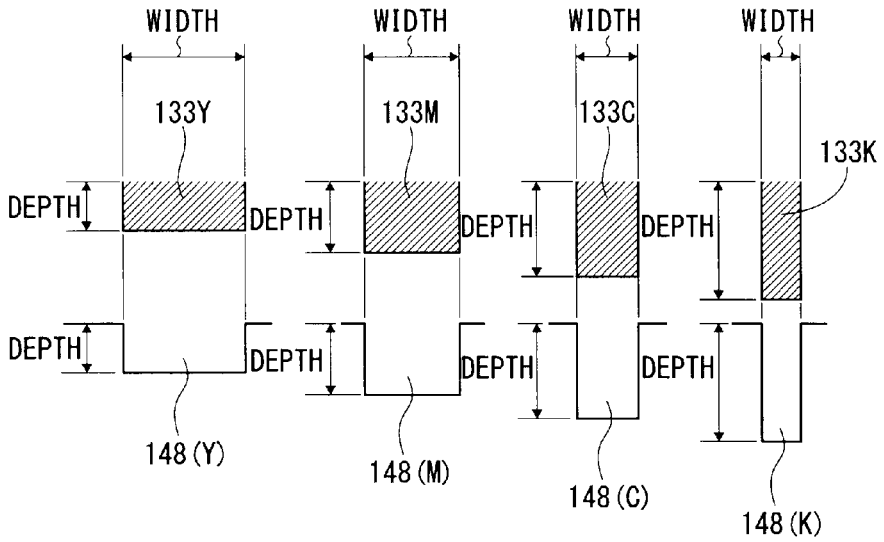
FIG. 40 is an enlarged view describing one embodiment in which the widths and the depths of the ribs and the grooves are changed according to a color of a toner.

As the color incompatibility method, a method of changing the protrusion amount of the rib from each opening and the depth of the groove with respect to each toner color, a method of changing the width of each rib and the width of each groove with respect to each toner color, or a method of changing the protrusion amount and the width of each rib 133 (Y, M, C, K) and the depth and the width of each groove 148 (Y, M, C, K) with respect to each toner color as shown in FIG. 40 can be used.

Figure 41:
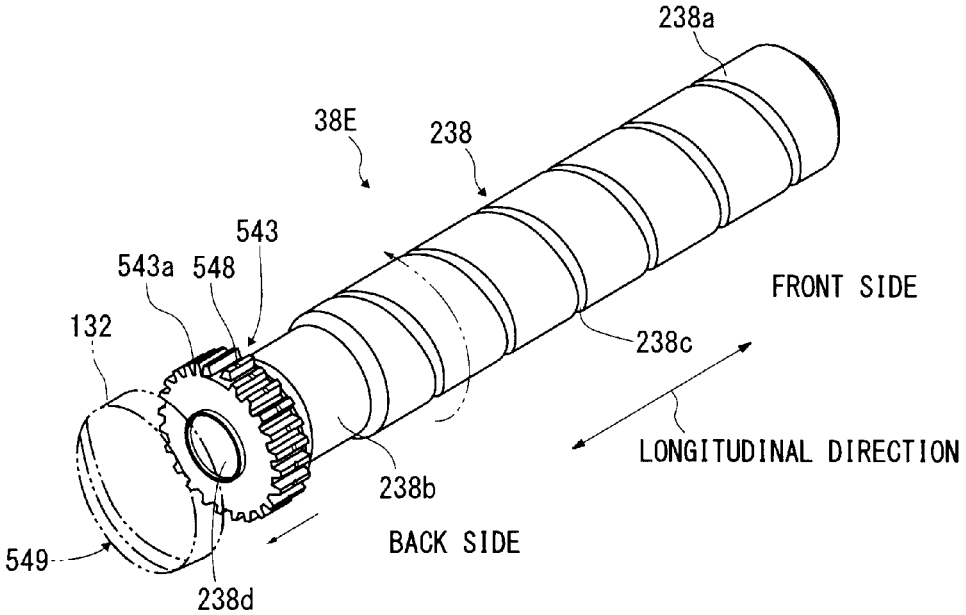
FIG. 41 is a perspective view showing color incompatibility using a gear and a concave-convex section in an opening as a color incompatibility discrimination section.

FIG. 41 shows another embodiment regarding the color incompatibility. In the above embodiment, the color incompatibility is ensured with the combination of the ribs 133 (Y, M, C, K) and the grooves 148 (Y, M, C, K). In this embodiment, a female screw or a male screw of a concave section or a convex section whose pitch is changed with respect to each toner color is formed in the tooth sections 543*a* of the gear 543 of the toner container 38E corresponding to each color as a discrimination section 548, and a male screw or a female screw of a convex section or a concave section which is opposite to that formed in the tooth sections 543*a* is formed in the inner circumferential face of the opening 132 corresponding to each color as a color incompatibility section 549 of a mounted section.

With this configuration, since only the toner container 38E corresponding to each color can be threadably mounted on the opening 132 corresponding to each color, the color incompatibility can be ensured. Moreover, the toner container E is always rotated when being attached or detached, so that the toner condensed in the container can be loosened.

In this case, different from the configuration shown in FIG. 41, if the female screw or the male screw is formed such that the direction of the female screw or the male screw becomes a direction opposite to the toner carrying direction by the spiral protrusion 238*c* formed in the toner container 238, the rotation direction when mounting the toner container 38E on the toner container housing section 31 becomes a direction opposite to the toner carrying direction by the spiral protrusion 238*c*, and the toner is brought back in the container when mounting the toner container on the toner container housing section 31, so that the toner can be effectively prevented from flying from the toner outlet 238*d*.

Figure 42A:
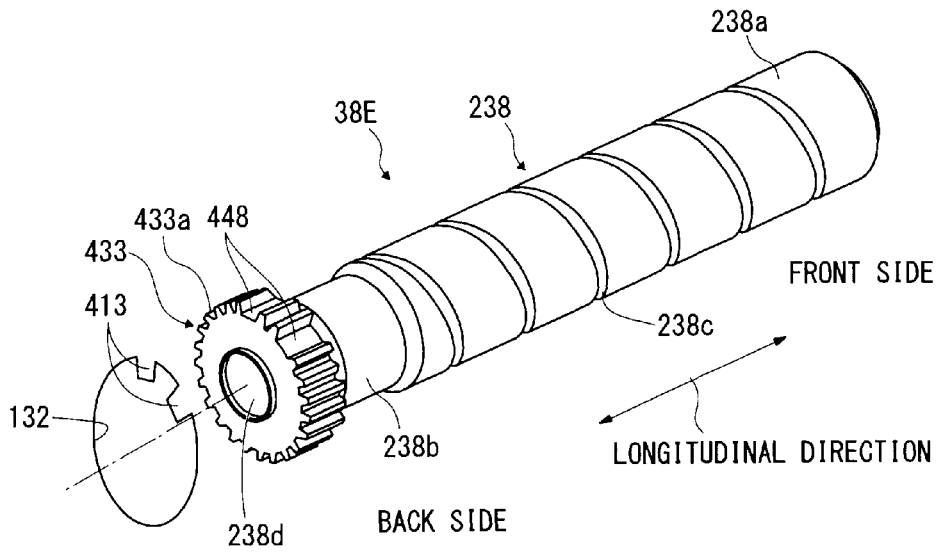
FIG. 42A is a perspective view showing color incompatibility by forming as a color incompatibility discrimination section a toothless section in a gear and a convex section in an opening.
Figure 42B:
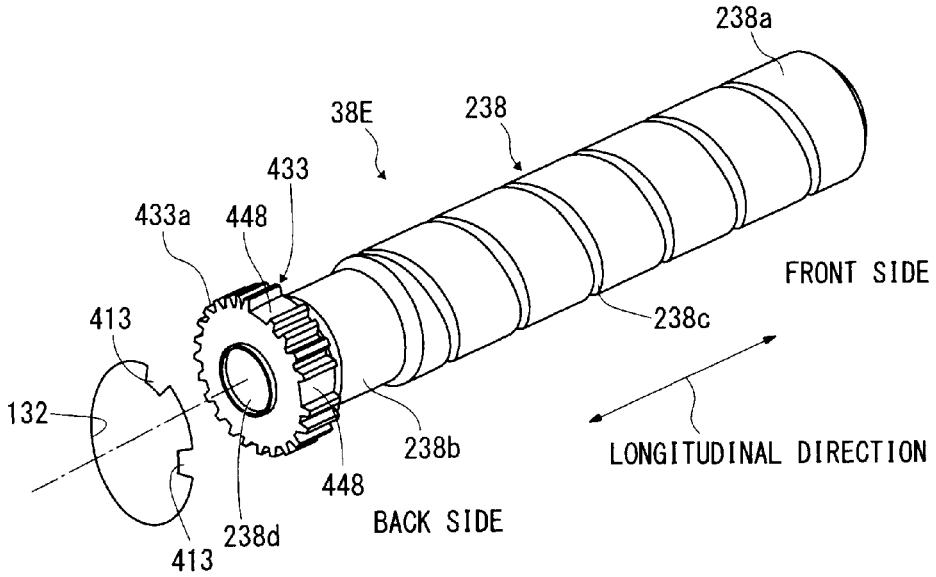
FIG. 42B is a perspective view showing an example in which the phase of the toothless section and the phase of the convex section differ.

FIGS. 42A, 42B show another embodiment regarding the color incompatibility. In the embodiment shown in FIGS. 42A, 42B, the position of the toothless section 448 of a concave section formed in the tooth sections 433*a* of the gear 433 formed in the second end side 238*b* of the body 238 of the toner container 38E is changed with respect to each toner color, and the convex section 413 of the mounted section which projects inward from the inner circumferential face of the opening is formed in the opening corresponding to each color in accordance with the position of the toothless section 448. Since the gear 433 meshes with the gear 184 (refer to FIG. 6) after the toner container is mounted on the toner container housing section 31, the range of the toothless portion 488 is set to a range which does not deteriorate the driving transfer. In this embodiment, the toothless section 448 in which one tooth is lost is formed in two positions of each gear according to each color with different phases, and the convex section 413 of the opening 132 of each color is formed in accordance with the width and the phase of the toothless section 448.

Therefore, if the phase of the toothless section 448 formed in the gear 433 of the toner container 38E does not match with the convex section 413 of the opening 132, the toner container 38E can not be inserted in the opening 132, so that the color incompatibility can be ensured.

Figure 43:
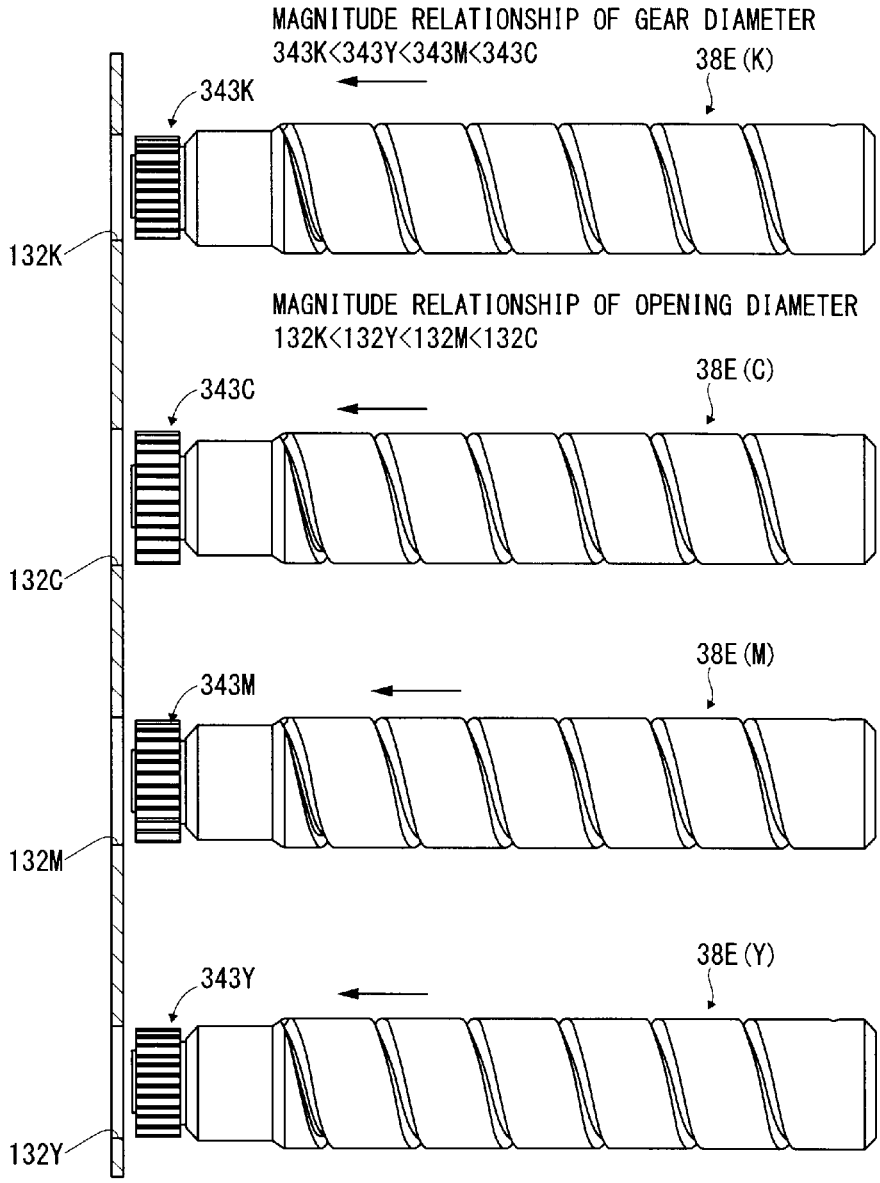
FIG. 43 is an enlarged view describing one example in which diameters of openings and diameters of gears as a color incompatibility discrimination section are changed according to a color of a toner.

FIG. 43 shows another embodiment regarding the color incompatibility. In the embodiment illustrated in FIG. 43, the gears 343Y, 343M, 343C, 343K without having the groove section 148 or the toothless section 448 are provided in the toner containers 38E (Y, M, C, K) corresponding to respective colors, and the diameters of respective gears are made to be different from one another with respect to respective toner colors and also the diameters of the openings 132Y, 132M, 132C, 132K of the mounted sections are made to be different from one another with respect to respective toner colors. In this case, the diameter of the gear 184 (refer to FIG. 6) on the driving side, which meshes with the gear 343 (Y, M, C, K) is set to the diameter which meshes with only the gear 343 (Y, M, C, K) with respect to each color.

According to the above-described configuration, the toner container 38E including the gear having the diameter larger than the diameter of the opening 132 (Y, M, C, K) can not be inserted in the opening, so that the color incompatibility can be ensured. The toner container 38E including the gear having the diameter smaller than that of the opening can be inserted in the opening even if the color differs. However, since the gear 184 of the driving system is set to be a diameter which meshes with only the gear 343 of the corresponding toner container 38E, the gear 343 of the different color toner container 38E can not mesh with the gear 184 if the different color toner container 38E is inserted. Accordingly, if a wrong color toner container 38E is provided in a wrong position, the driving force is not transferred to the incorrectly provided toner container 38E, so that the wrong color toner supply can be prevented; thus, the color incompatibility can be ensured with this toner supply inability situation.

When mounting each toner container on the toner container housing section 31, the color incompatibility can be visually confirmed, but it may be difficult to see the color incompatibility section when separating each color toner container from the toner container housing section 31.

Figure 44A:
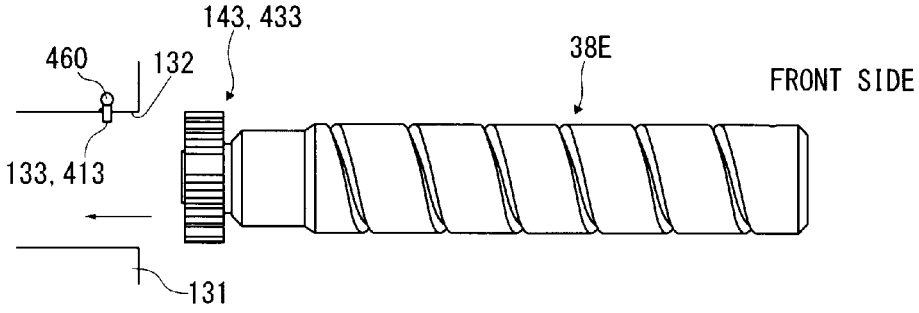
FIG. 44A is a view showing that a convex section and a rib of an opening as a color incompatibility section occupy a protrusion position.
Figure 44B:
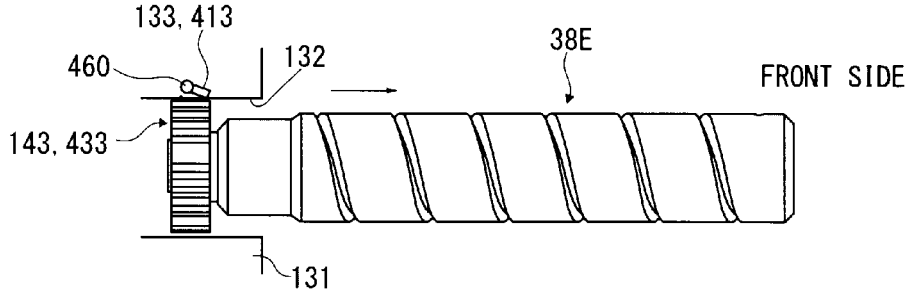
FIG. 44B is a view showing that the convex section and the rib of the opening as the color incompatibility section occupy a retracted position.
Figure 45:
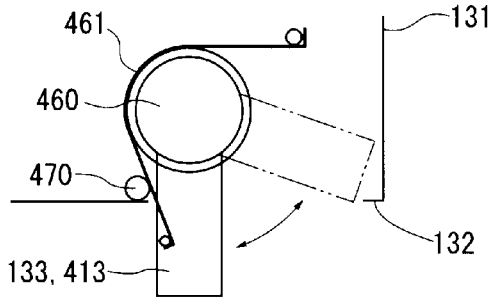
FIG. 45 is an enlarged view showing a configuration of a supporting mechanism which supports the rib and the convex section to be displaceable in the protrusion position and the retracted position.

Therefore, in another embodiment regarding the color incompatibility shown in FIGS. 44A, 44B, 45, when mounting each color toner container on the toner container housing section 31, the rib 133 and the convex section 413 occupy the protrusion position located in the opening shown in FIG. 44A, and when separating each color toner container from the toner container housing section 31, the rib 133 and the convex portion 413 shown in FIG. 44B occupy the retracted position which retracts from the opening 132.

Specifically, the rib 133 and the convex section 413 are rotatably supported by the shaft 460 near the opening 132 as illustrated in FIG. 45, and the rib 133 and convex section 413 are urged by the coil spring 461 of an urging device in the opening 132 or in the direction which enters in the insertion area of the toner container as shown in FIG. 44A. In order to maintain the rib 133 and the convex section 413 which are urged by the coil spring 461 in the protrusion position, the stopper 470 is arranged in the back side of the toner container housing section 31 farther than the convex section 413, so that the protrusion position can be maintained by hitting the rib 133 and the convex section 413 to the stopper 470.

With this configuration, as shown in FIG. 44A, when the toner container 38E is inserted in the opening 132 from the front side of the apparatus, if the positions of the rib 133 and the groove 148 in the toner container having the gear 143 are matched and the positions of the convex section 413 and the toothless section 448 in the toner container having the gear 433 are matched, namely, if the color of the toner container 38E matches with the color of the opening 132, the toner container 38E can be inserted in the opening 132 and also can be mounted on the toner container housing section 31. However, if the position of the rib 133 does not match with the position the groove 148 and the position of the convex section 413 does not match with the position of the toothless section 448, namely, if the color of the toner container 38E does not match with the color of the opening 132, the insertion of the toner container 38E is disturbed by the rib 133 and the convex section 413 which occupy the protrusion position, so that the color incompatibility can be ensured.

On the other hand, when removing the toner container 38E mounted on the toner container housing section 31, as shown in FIG. 44B, the toner container 38E is pulled on the front side of the apparatus by a user. In this case, the rib 133 and the convex section 413 which occupy the protrusion position are pushed up to the retracted position against the urging force of the coil spring 461 by the gear 143 and the gear 433 of the container body 238. Accordingly, compared to a fastened state which does not rotatably support the rib 133 and the convex section 413, the toner container 38E can be easily removed from the toner container housing section 31 without matching the positions of convex section 413 and the toothless section 448 and the positions of the rib 133 and the groove 148, so that the removal performance of the toner container 38E can be improved while ensuring the color incompatibility.

Next, another embodiment of a powder container including a gear having a screw groove for fixing a cap will be described with reference to FIG. 46.

In each embodiment and each modified example, the groove of each gear is formed by a cutting process (the secondary process after forming a gear) on the circumferential face of each gear. However, in view of mass production (reduction in one toner container manufacturing time), the manufacturing time can be reduced by bonding parts of the gear.

Figure 46:
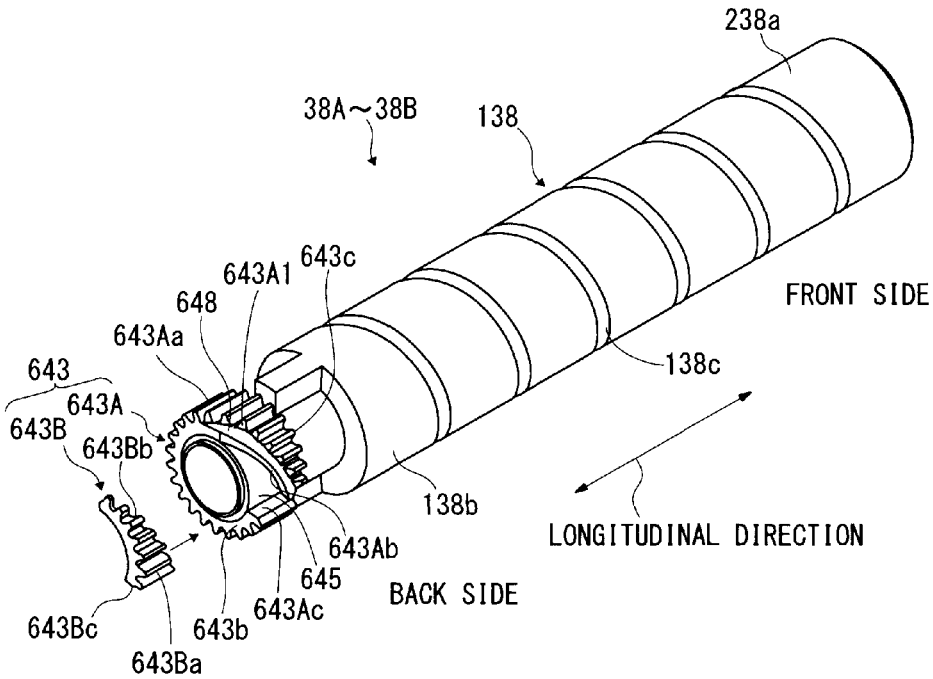
FIG. 46 is a perspective view showing a configuration of a powder container including a gear of which a part is removable.

In this embodiment, as illustrated in FIG. 46, a part of tooth sections is formed separately from the gear, and the groove section is formed by attaching a part of the tooth portions to the gear. FIG. 46 shows an example in which the gear 643 of a feature of this embodiment is mounted instead of the gear 143 of the toner container 38A-38E described in FIGS. 23A-23C.

This gear 643 includes a first member 643A of a container side member, which is formed in the second end side 138*b* of the container body 138 and a second member 643B attached to the first member 643A. By fixing the second member 643B to the first member 643A, one spur gear can be formed. A part of the tooth sections 643Ac of the first member 643A is formed by previously cutting at an angle such that the spiral groove 648 is formed between the first member and the second member 643B when the second member 643B is mounted on the first member 643A. The cut portion 643A1 of the tooth sections 648Aa is formed on the end face 643*c* side of the gear 643 farther than the end face 643Ac. The end face 643Ab and the end face 643Ac form surfaces which have contact with the second member 643B. The end face 643Ab forms a surface parallel to the cut portion 643A1, and the end face 643Ac forms a surface parallel to the tooth. Namely, a part of the first member 643A includes a cut area 645 having a shape which is the same as that of the second member 643B.

The second member 643B is formed in the shape which is the same as that of the cut area 645 of the first member 643A and includes the contact end face 643Bb and the contact end surface 643Bc which have contact with the end face 643Ab and the end face 643Ac of the first member 643A. The second member 643B includes on the outer circumferential surface thereof tooth sections 643Bc facing the tooth sections 643Aa when the second member 643B is mounted on the first member 643A.

According to the above-described configuration, the second member 643B is disposed in the cut area 645 of the first member 643A, the contact end face 643Bb and the contact end face 643Bc of the second member 643B are fastened to the end face 643Ab and the end face 643Ac of the first member 643A with bonding agent or by thermal adhesion, so that the gear 643 can be formed in the second end side 138*b* of the container body 138. In this embodiment, the cut portion 643A1 of the tooth sections 648Aa is formed on the end face 643*c* side of the gear 643 to be closer to the end face 643*c* of the gear 643, so that the groove 648 can be formed with the cut portion 648A1 of the tooth sections 643Aa and the end face 643Bb of the second member 643B when the second member 634B is mounted on the first member 643A. Namely, a part of the tooth sections of the gear 643 is constituted as the second member 643B, and the gear 643 is divided in the portion of the first member 643A and the groove section 648.

By forming the gear 643 on the second end side 138*b* of the container body 138 with this processing method (forming method) of the gear 643, the manufacturing time can be reduced. The groove 648 can be formed in the gear 643 by forming the end face 643Bb of the second member 643B to retract on the end face 643*b* side of the gear 643 than the end face of the tooth sections 643Ba The powder container to which the gear 643 is applied is not limited to the toner container 38A-38D, and the gear 643 can be applied to the toner container 38E shown in the figures after FIG. 24.

According to the above-described embodiments, since the cap which is mounted on the gear to cover at least the tooth sections of the gear formed in the toner container from the entire circumferential direction is provided, the gear and the tooth sections of the toner container can be prevented from being damaged with the simple configuration without increasing the length of the cap in the longitudinal direction of the toner container.

In the powder supply device and the image-forming apparatus using such a powder container, the generation of the abnormal noise, the damage of the driving system and the rotation error of the powder container can be reduced by preventing the damage of the gear, so that a high-quality image can be formed with the stable toner supply.

Although the embodiments of the present invention have been described above, the present invention is not limited thereto. It should be appreciated that variations may be made in the embodiments described by persons skilled in the art without departing from the scope of the present invention.

What is claimed is:

1. A powder container which is mounted on an image-forming apparatus body, and houses a powder, comprising:

a container body configured to carry the powder housed inside thereof from a first end side to a second end side by rotating, and discharge the powder outside from the second end side;

a gear formed in an outer circumference of the container body; and a cover which is directly mounted on the gear to cover at least a tooth section of the gear.

2. The powder container according to claim 1, wherein the cover includes a tubular body and a convex section formed toward an inward side of the tubular body, and the tooth section of the gear includes a groove configured to engage with the convex section when the cover is mounted on the gear.

3. The powder container according to claim 1, wherein the cover includes a tubular body and a convex section formed toward an inward side of the tubular body, and the container body includes a groove on an outer circumferential face closer to a container center than the gear.

4. The powder container according to claim 1, wherein the cover includes a tubular body and a click section which is formed toward an inward side of the body in an end portion of the tubular body and configured to engage with an end face of the gear when the cover is mounted on the gear.

5. The powder container according to claim 2, wherein at least the groove is a spiral groove in the groove of the tooth section and the convex section of the cover.

6. The powder container according to claim 1, further comprising:

a nozzle receiver having a nozzle-receiving hole arranged on the second end side of the container body and configured to allow a transport nozzle having a powder-receiving inlet to be inserted therein, and a supply port arranged in at least a part of the nozzle receiver and configured to supply the powder in the container body to the powder-receiving inlet, and a shutter which is supported by the nozzle receiver and configured to open and close the nozzle-receiving hole by sliding in response to the insertion of the transport nozzle into the nozzle receiver.

7. The powder container according to claim 1, wherein the container body includes an outlet formed in an end face of the second end side and configured to discharge powder in the powder container, and the cover includes a face configured to seal the outlet when the cover is mounted on the gear.

8. The powder container according to claim 2, wherein the groove provided in the tooth section is formed in a shape which differs according to a color of the powder housed in the container body.

9. The powder container according to claim 8, wherein the groove is formed in a shape which matches with a shape of a mounted portion formed in the image-forming apparatus body side according to a color of the powder.

10. The powder container according to claim 2, wherein a part of the tooth section is formed separately from the gear, and the groove is formed by mounting the part of the tooth section to the gear.

11. The powder container according to claim 10, wherein the part of the tooth section is formed by dividing in a portion of the groove and the gear.

12. The power container according to claim 1, wherein the cover is a cap which covers at least the tooth section of the gear from an entire circumference direction.

13. A powder supply device having a carrier, which carries a toner of a powder discharged from a powder container to a development device, comprising the powder container according to claim 1 as the powder container.

14. An image-forming apparatus comprising the powder supply device according to claim 13.

15. The powder container according to claim 1, wherein:

the cover is not used to retain the powder within the powder container and removal of the cover does not result in an emission of the powder from the powder container.

16. The powder container according to claim 1, wherein:

the powder is retained within the powder container without flowing out of the powder container, even when the cover is removed from the powder container.

17. The powder container according to claim 1, wherein the powder container includes toner therein.

18. The powder container according to claim 1, wherein the cover comprises a resin material.

19. The powder container according to claim 7, wherein the face contacts an edge of the outlet when the cover is mounted on the gear.

20. The powder container according to claim 7, wherein the cover includes an elastic seal on the face, and the elastic seal on the face makes contact with an edge of the outlet when the cover is mounted on the gear.

21. The powder container according to claim 12, wherein a depth of the cap is larger than a width of the gear in a longitudinal direction of the container body.

22. The powder container according to claim 12, wherein the cover covers an entire area of the tooth section of the gear in a longitudinal direction of the container body.

23. The powder container according to claim 1, wherein the tooth section of the gear includes a toothless section which is provided in a position in a circumferential direction of the gear, and the position of the toothless section corresponds to a color of the powder housed in the container body.

24. The powder container according to claim 23, wherein a width of the toothless section corresponds to the color of the powder housed in the container body.

25. The powder container according to claim 1, wherein a diameter of the gear corresponds to a color of the powder housed in the container body.

* * * * *